US008715142B1

(12) United States Patent
Leach

(10) Patent No.: US 8,715,142 B1
(45) Date of Patent: May 6, 2014

(54) USER-ADJUSTABLE RESISTANCE MECHANISMS AND EXERCISE APPARATUSES EMPLOYING THE SAME

(76) Inventor: Justin James Leach, Phoenix, AZ (US)

( * ) Notice: Subject to any disclaimer, the term of this patent is extended or adjusted under 35 U.S.C. 154(b) by 659 days.

(21) Appl. No.: 12/978,284

(22) Filed: Dec. 23, 2010

Related U.S. Application Data

(60) Provisional application No. 61/289,619, filed on Dec. 23, 2009.

(51) Int. Cl.
*A63B 21/00* (2006.01)

(52) U.S. Cl.
USPC ..... 482/93; 482/94; 482/102

(58) Field of Classification Search
USPC ..... 482/93, 94, 101, 102, 103, 104
See application file for complete search history.

(56) References Cited

U.S. PATENT DOCUMENTS 5,931,767 A * 8/1999 Morales ..... 482/102
6,231,486 B1 * 5/2001 Lee ..... 482/101
6,932,748 B2 * 8/2005 Huang ..... 482/139
7,766,803 B2 * 8/2010 Carter ..... 482/102
2005/0113217 A1 * 5/2005 Kuo ..... 482/99

* cited by examiner

*Primary Examiner* — Jerome W Donnelly

(57) ABSTRACT

Embodiments of a user-adjustable resistance mechanism, and embodiments of an exercise apparatus employing such a user-adjustable resistance mechanism, are provided. In one embodiment, the exercise apparatus includes a support structure, a user-manipulated element movably coupled to the support structure and configured to be moved by a user during the performance of an exercise in opposition to an output resistance, and a user-adjustable resistance mechanism. The user-adjustable resistance mechanism includes, in turn, an input resistance assembly and a lever assembly comprising a first plurality of levers rotatably coupled in series between the user-manipulated element and the support structure. The input resistance assembly is configured to be selectively coupled by a user to the lever assembly at any one of a plurality of locations to determine the cumulative load arm length of the first plurality of levers and the output resistance opposing movement of the user-manipulated element.

21 Claims, 17 Drawing Sheets

USER-ADJUSTABLE RESISTANCE MECHANISMS AND EXERCISE APPARATUSES EMPLOYING THE SAME

CROSS-REFERENCES TO RELATED APPLICATIONS

This application claims priority to U.S. Provisional Application Ser. No. 61/289,619, filed Dec. 23, 2009, the entire contents of which are hereby incorporated by reference.

TECHNICAL FIELD

The present invention relates generally to exercise equipment and, more particularly, to embodiments of a user-adjustable resistance mechanism including a selectorized lever assembly, as well as to embodiments of an exercise apparatus employing such a user-adjustable resistance mechanism.

BACKGROUND

Exercise machines that utilize a selectorized weight stack to resist the movements of a user are commonplace in homes and commercial workout facilities. A generalized stacked weight exercise machine includes a support structure, a selectorized weight stack, and a user-manipulated element, such as a handle or bar (e.g., a pull-down bar). The support structure supports the user-manipulated element and a selectorized weight stack. A vertical rod extending through the selectorized weight stack is coupled to the user-manipulated element by way of cable, belt, or other flexible linkage. The rod includes a plurality of horizontal channels therethrough. The selectorized weight stack also includes a plurality of horizontal channels, which each extend through a different weight in the stack, and a vertical channel, which accommodates the rod in its normal (resting) position. When the rod resides in its resting position, the rod's channels align with those provided through the selectorized weight stack. A user selects a desired output resistance by inserting a selector pin into the channel of a selected weight thus fixing the selected weight to the vertical bar. To subsequently move the user-manipulated element during the performance of an exercise, the user must exert enough force on the user-manipulated element to lift the selected weight, and the weights residing above it, from their resting position.

Exercise machines including selectorized weight stacks of the type described above are limited in certain respects. For example, due to the presence of the weight stack, such machines tend to be relatively heavy and cumbersome and consequently less desirable for residential use and for other applications wherein weight capacity is limited. In addition, the stacked weights may crack and possibly break if returned to their resting position too quickly. Stacked weight exercise machines may produce excessive noise during use. As a further limitation, inertia of the weight stack may result in undesirable fluctuations in resistance during the performance of an exercise, especially if the user moves the user-manipulated element in an abrupt manner.

To overcome the above-noted disadvantages, exercise machines have been developed that utilize alternative resistance means to oppose the movements of the user. Of these alternative resistance exercise machines, those employing resilient resistance means (e.g., bendable rods or elastic bands) have achieved the greatest commercial success. However, such resilient resistance exercise machines are also associated with a number of disadvantages. Such resilient resistance exercise machines are often relatively bulky, complex, and expensive to produce. In contrast to stacked weight exercise machines, which permit the selection of a desired weight by a relatively simple process (i.e., the insertion of a selector pin), resilient resistance exercise machines may require that the user perform several steps to select a desired resistance. Finally, many resilient resistance exercise machines do not provide a substantially constant or linear resistance profile through the user's full range of motion.

Considering the above, it should be appreciated that it would be desirable to provide embodiments of a user-adjustable resistance mechanism suitable for employment within an exercise machine that overcomes the above-noted disadvantages. In particular, it would be desirable to provide a user-adjustable resistance mechanism that would enable a user to select amongst a plurality of output resistances derived from a single input resistance utilizing, for example, an intuitive selection interface similar to that employed by traditional stacked weight exercise machines. It would also be desirable if, in certain embodiments, the user-adjustable resistance mechanism provided a substantially constant or linear resistance profile throughout the user's range of motion. Other desirable features and characteristics of the present invention will become apparent from the subsequent Detailed Description and the appended claims, taken in conjunction with the accompanying drawings and the Background of the Invention.

BRIEF SUMMARY

Embodiments of a user-adjustable resistance mechanism, and embodiments of an exercise apparatus employing such a user-adjustable resistance mechanism, are provided. In one embodiment, the exercise apparatus includes a support structure, a user-manipulated element movably coupled to the support structure and configured to be moved by a user during the performance of an exercise in opposition to an output resistance, and a user-adjustable resistance mechanism. The user-adjustable resistance mechanism includes, in turn, an input resistance assembly and a lever assembly comprising a first plurality of levers rotatably coupled in series between the user-manipulated element and the support structure. The input resistance assembly is configured to be selectively coupled by a user to the lever assembly at any one of a plurality of locations to determine the cumulative load arm length of the first plurality of levers and the output resistance opposing movement of the user-manipulated element.

In another embodiment, an exercise apparatus includes a user-adjustable resistance mechanism and a user-manipulated element configured to be moved by a user during the performance of an exercise. The user-adjustable resistance mechanism includes a linearly-articulating lever assembly, an input load, and a lever-load adapter mechanically coupled to the input load. The linearly-articulating lever assembly is coupled to the user-manipulated element and configured to extend along an extension/retraction axis as the user-manipulated element is moved by the user during the performance of an exercise. The lever-load adapter is configured to be selectively mechanically coupled by the user to the linearly-articulating lever assembly at any one of a plurality of locations. Each location in the plurality of locations travels a different distance as the first plurality of linearly-articulating lever assembly extends along the extension/retraction axis such that the displacement of the input load is dependent upon the location at which the user has coupled the lever-load adapter to the linearly-articulating lever assembly.

In a further embodiment, an exercise apparatus is provided that includes a user-adjustable resistance mechanism and a user-manipulated element configured to be moved by a user during the performance of an exercise. The user-adjustable resistance mechanism includes an input resistance assembly configured to provide at least one predetermined resistance, and a lever assembly including a first plurality of series-coupled levers coupled to the user-manipulated element. The lever assembly cooperates with the input resistance assembly to enable the user to manually select which lever in the first plurality of series-coupled levers is coupled most directly to the input resistance assembly to determine the cumulative load arm of the first plurality of series-coupled levers and the magnitude of the output resistance derived from the at least one predetermined input resistance.

In a still further embodiment, the exercise apparatus includes a support structure, a user-manipulated element movably coupled to the support structure and configured to be moved by a user during the performance of an exercise in opposition to an output resistance, and a user-adjustable resistance mechanism. The user-adjustable resistance mechanism includes, in turn, an input resistance assembly and a selectorized lever assembly. The selectorized lever assembly includes a first portion mounted to the support structure, a second portion mechanically coupled to the user-manipulated element and moving in conjunction therewith such that the selectorized lever assembly extends as the user-manipulated element is moved by a user, and a plurality of user-selectable coupling features between the first portion and the second portion of the selectorized lever assembly. Each coupling feature in the plurality of user-selectable coupling features: (i) travels a different distance as the selectorized lever assembly extends, and (ii) is configured to be selectively mechanically coupled to the input resistance assembly by a user to determine the magnitude of the output resistance opposing extension of the selectorized lever assembly and, therefore, the magnitude of the output resistance opposing movement of the user-manipulated element.

In a still further embodiment, the exercise apparatus includes a support structure, a user-manipulated element movably coupled to the support structure and configured to be moved by a user during the performance of an exercise in opposition to an output resistance, and a user-adjustable resistance mechanism. The user-adjustable resistance mechanism includes, in turn, a lever assembly including a first plurality of levers rotatably coupled in series between the user-manipulated element and the support structure, resistive means for providing at least one predetermined input resistance, and coupling means for selectively coupling the resistive means to the lever assembly at any one of a plurality of locations to determine the cumulative load arm of the first plurality of levers and the magnitude of the output resistance derived from the at least one predetermined input resistance.

Additional embodiments of the user-adjustable resistance mechanism, and exercise apparatuses employing such a user-adjustable resistance mechanism, are also provided herein.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description. As appearing herein, the phrase "is dependent upon," the phrase "to determine," and similar phrases are utilized to indicate that a stated condition or conditions (e.g., the user selection of the location at which the input resistance assembly/input load is coupled to the selectorized lever assembly) has an influence or effect on a stated outcome (e.g., the resistive output force opposing the movement of the user-manipulated element) and not necessarily that the stated conditions or conditions are wholly determinative of the stated outcome. Furthermore, as generally defined in continuum mechanics, the term "displacement" is utilized herein to encompass movement of one or more rigid bodies from an initial position to a secondary position (e.g., linear movement of a bulk weight, a hydraulic piston, or a pneumatic piston, or rotation of a disk resisted by frictional or magnetic forces), as well as the deformation of one or more resilient bodies, such as an elastic band, bendable rod, or spring. As appearing herein, the phrase "configured to provide at least one predetermined resistance" and similar phrases are utilized broadly to encompass embodiments of the user-adjustable resistance mechanism and exercise apparatus wherein the input load independently supplies at least one input resistance, as well as embodiments wherein the input load cooperates with one or more external elements to provide at least one input resistance, such as when the input load includes or assumes the form of a vertically-moving platform onto which one or more weighted bodies can be placed, a container that can be filled with water or other readily-available filler material, a cylindrical post onto which one or more conventional disc weights can be loaded, or the like. The phrase "lever assembly" is utilized herein to denote an assembly of structural elements/components that includes a plurality of levers rotatably coupled together, whether directly or indirectly utilizing any number of intervening components. Similarly, the phrase "selectorized lever assembly" is utilized to denote a lever assembly, as previously defined, that is adapted to or cooperates with any number of external elements (e.g., a selector pin and a lever-load adapter of the type described below) to enable a user to select which portion of the lever assembly is coupled most directly to an input resistance. Finally, the term "exercise apparatus" is utilized in a broad sense to denote any device or implement, regardless of size or complexity, suitable for performing one or more exercises, including both freestanding exercise machines and user-portable exercise devices.

Figure 1:
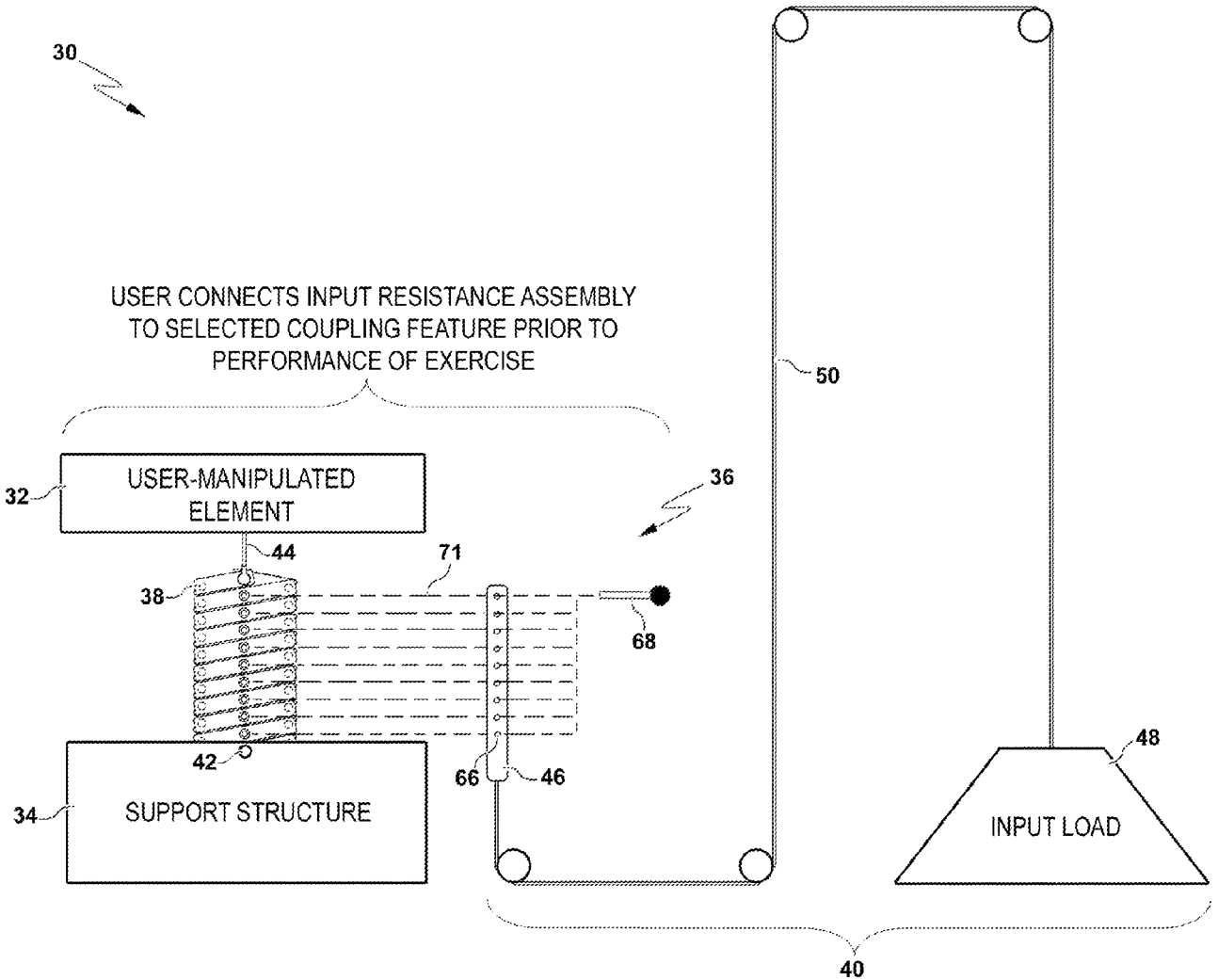
FIG. 1 is a functional view of a generalized exercise machine in a resting position in accordance with a first embodiment of the present invention.

FIG. 1 is a functional view of a generalized exercise apparatus or machine 30 in a non-active or resting position in accordance with a first embodiment of the present invention. Exercise machine 30 includes a user-manipulated element 32, a support structure 34, and a user-adjustable resistance mechanism 36. User-adjustable resistance mechanism 36, in turn, includes a linearly-articulating, selectorized lever assembly 38 and an input resistance assembly 40. Selectorized lever assembly 38 is mechanically coupled between user-manipulated element 32 and support structure 34. In the illustrated exemplary embodiment, specifically, a first end portion of selectorized lever assembly 38 (the lower end portion in the illustrated orientation) is mounted to support structure 34 as generally shown in FIG. 1 at 42; and a second, opposing end portion of selectorized lever assembly 38 (the upper end portion in the illustrated orientation) is coupled to user-manipulated element 32. As indicated in FIG. 1, the second end portion of selectorized lever assembly 38 may be mechanically connected to user-manipulated element 32 via a flexible link, such as a cable 44; however, the second end portion of selectorized lever assembly 38 may be directly attached to user-manipulated element 32 or indirectly coupled thereto utilizing any number of linking elements, whether flexible or rigid, in alternative embodiments. In further embodiments, user-manipulated element 32 and/or support structure 34 may be connected, either directly or indirectly, to an intermediate portion of selectorized lever assembly 40. In still further embodiments, user-manipulated element 32 and support structure 34 may be mechanically coupled to different levers included within the same end portion of selectorized lever assembly 38.

Support structure 34 may comprise any structural element or assemblage of structural elements that maintains the position of, or at least that restrains the movement of, the portion of selectorized lever assembly 38 mounted to support structure 34 to enable relative movement between the portion of lever assembly 38 mounted to support structure 34 and the portion of lever assembly 38 mechanically coupled to user-manipulated element 32. In embodiments wherein exercise machine 30 comprises a freestanding exercise machine, such as a multi-station gym, a functional trainer, or the like, support structure 34 will often include at least one base member. Support structure 32 may also include various combinations of linkages, pulleys, cables, cams, levers, and other movable elements of the type which are generally combined to produce one or more workout stations. In certain embodiments, especially in lightweight, user-portable embodiments, support structure 34 may include one or more structural elements that are adapted to engage an external structure or a user's body. For example, in embodiments wherein exercise machine 30 assumes the form of a portable, pull-type exercise device, support structure 34 may be adapted to be mounted to the frame of a doorway or may be adapted to engage one or more appendages of the user; e.g., support structure 34 may include foot stirrups into which the user inserts his or her feet when in, for example, a seated position.

User-manipulated element 32 may comprise any structural element or elements moved by a user during the performance of an exercise. A non-limiting list of exemplary forms that may be assumed by user-manipulated element 32 includes various types of handles, harnesses, straps (e.g., ankle and wrist straps), bars, footplates (e.g., if exercise machine 30 should assume the form of a leg press machine), rotatable seats (e.g., if exercise machine 30 should assume the form of an oblique machine), yokes (e.g., if exercise machine 30 should assume the form of a standing calf raise machine), padded members (e.g., if exercise machine 30 should assume the form of a quadriceps extension, hamstring curl, or neck machine permitting cervical flexion, extension, and/or bilateral flexion), sleds (e.g., if exercise machine 30 should assume the form of a hack squat machine), platforms (e.g., if exercise machine 30 should assume the form of an assisted pull-up or dip station), and so on.

With continued reference to the exemplary embodiment illustrated in FIG. 1, input resistance assembly 40 includes two primary components, namely, a lever-load adapter 46 and an input load 48. Input load 48 may be mechanically coupled to lever-load adapter 46 by way one or more linking elements, such as a pulley system 50. Alternatively, input load 48 may be directly connected to lever-load adapter 46. As a point of emphasis, input load 48 may comprise any structural element or assemblage of structural elements that provides (or that cooperates with any number of external elements to provide) a resistive input force or range of resistive input forces from which a plurality of output resistive forces can be derived. As a first example, input load 48 may comprise a bulk weight, such as a relatively heavy block of metal, alloy, rubber, plastic- or rubber-encased concrete, plastic- or rubber-encased sand, or the like. As a second example, input load 48 may include a receptacle or container that may receive or hold a weighted object (e.g., one or more pairs of fixed weight or selectorized dumbbells) or a readily-available filler material; e.g., in certain embodiments, input load 48 may comprise a container that a user may fill with water, sand, gravel, or other such material. As a third example, input load 48 may comprise a structure, such as a cylindrical post or sleeve, onto which a user may load one or more weighted bodies, such as one or more conventional disc weights of the type commonly utilized in conjunction with non-fixed weight barbells. Input load 48 may further comprise a sled or other movable body that supports the weight of a user during usage of exercise machine 30. A non-exhaustive list of still further components suitable for use as, or employment within, input load 48 includes various combinations of elastomeric resistance bands, springs, frictional devices, bendable rods, magnetic resistance devices, and working fluid resistance devices (e.g., pneumatic cylinders, hydraulic cylinders, water-based resistance mechanisms, and the like). Furthermore, in certain embodiments, input load 48 may include one or more electronic components, such as an electromagnet or motor.

As will be described in detail below, selectorized lever assembly 38 cooperates with lever-load adapter 46 to enable a user to select and reselect, as desired, the site or location at which input load 48 is connected to lever assembly 38. By selecting the location at which input load 48 is connected to lever assembly 38, the user selects the mechanical advantage provided by selectorized lever assembly 38 and, therefore, the magnitude of the output resistance derived from input load 48. In embodiments wherein input load 48 provides a substantially uniform or constant resistance profile through the full range of motion of user-manipulated element 32 (excluding inertia in the case of weight-based types of resistances), selectorized lever assembly 38 and lever-load adapter 46 enable a user to select amongst a plurality of different resistive output forces with each resistive output force likewise providing a substantially uniform or constant resistance profile through the full range of motion of user-manipulated element 32. As noted above, many exercisers prefer a substantially uniform or constant resistance profile as such a resistance profile approximates weight-based exercise implements (e.g., dumbbells and barbells) and stacked-weight exercise machines commonly found in commercial and non-commercial gyms. Thus, for the purposes of the subsequent example, the following will assume input load 48 provides a substantially uniform or constant resistance profile; i.e., a substantially zero slope force-versus-displacement characteristic. It is, however, emphasized that input load 48 may provide any resistance profile and still enable user-adjustable resistance mechanism 36 and, more generally, exercise machine 30 to function; indeed, in certain embodiments, it may be desirable for input load 48 to provide a non-uniform resistance profile as described more fully below. Furthermore, it will be readily recognized by one of ordinary skill in the industry that input load 48 may include at least one resistive element having a non-uniform resistance profile (e.g., one or more springs, bendable rods, elastic bands, or other resilient-type resistive elements, which may or may not accord with Hooke's law) that cooperates with one or more cams (or similar structural elements) to provide a substantially uniform or constant output resistance profile.

Figure 2:
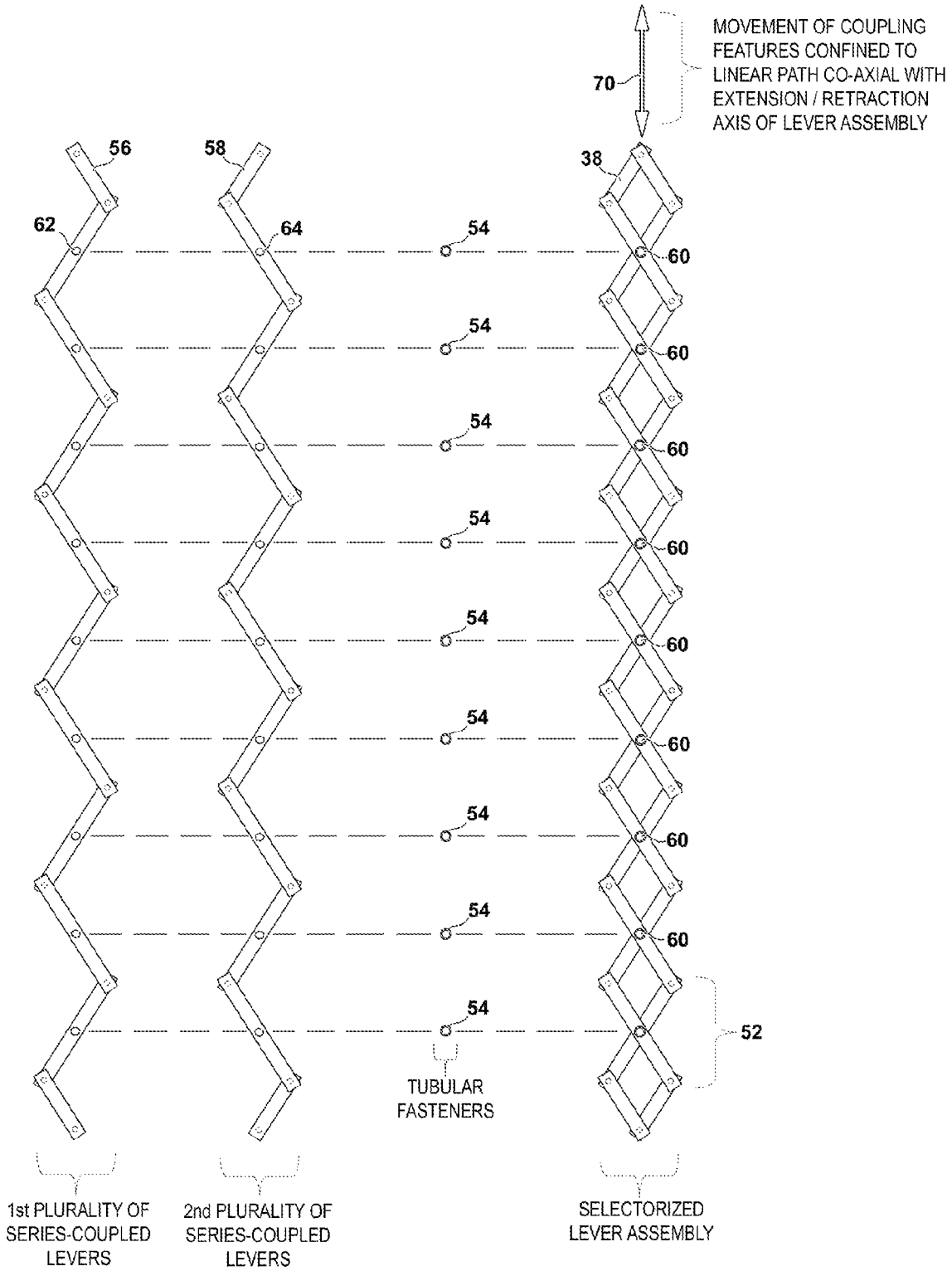
FIG. 2 is a diagram illustrating the components of the selectorized lever assembly (exploded and assembled) included within the generalized exercise machine shown in FIG. 1 in an extended position.

FIG. 2 is a diagram illustrating the components of selectorized lever assembly 38 (exploded and assembled) in an extended position. In exemplary embodiment illustrated in FIGS. 1 and 2, selectorized lever assembly 38 comprises a plurality of scissor linkages 52 (one of which is labeled in FIG. 2), which are joined together in an end-to-end or linearly articulating configuration. Each scissor linkage 52 in selectorized lever assembly 38 comprises first and second levers rotatably joined together by a central fastener, such as a rivet 54. Stated differently, selectorized lever assembly 38 comprises a first plurality of series-coupled levers 56 and a second plurality of series-coupled levers 58, which are joined together by rivets 54 to form the plurality of scissor linkages 52 shown in the rightmost column in FIG. 2. Each rivet 54 extends through a central aperture 62 (one of which is labeled in FIG. 2) provided through a first lever in series-coupled levers 56 and through an aligning central aperture 64 (again, one of which is labeled in FIG. 2) provided through a second lever in series-coupled levers 58. In this particular example, series-coupled levers 56 and 58 each include a number of bar links, which are rotatably joined together in an end-to-end arrangement; i.e., with the exception of the terminal bar links, each bar link includes first and a second end portions rotatably joined by pin joints to the end portions of first and second neighboring bar links, respectively. This example notwithstanding, it will be readily appreciated that any structural element or elements having a geometry and rigidity sufficient to function as a lever may be utilized in place of bar links in alternative embodiments (e.g., elongated hollow beams having circular, rectangular, or square cross-sectional geometries), and that levers 56 and 58 can be joined utilizing various other rotatable coupling means and intervening structures. In further embodiments, series-coupled levers 56 and 58 may include additional structural elements (e.g., bearings, strengthening members, lateral spacing members, pins, etc.), which may be interspersed with levers 56 and 58 in various manners.

Selectorized lever assembly 38 further includes a plurality of user-selectable coupling features 60, each of which may be selectively mechanically coupled to input resistance assembly 40 by a user to determine the magnitude of the resistance opposing the movement of user-manipulated element 32. In this particular example, each user-selectable coupling feature 60 assumes the form of a channel formed through selectorized lever assembly 38. The disposition of user-selectable coupling features 60 will inevitably vary amongst different embodiments, and, in certain embodiments, multiple coupling features 60 may be formed in, on, or connected to different portions of a single lever included within selectorized lever assembly 38. This notwithstanding, it is generally preferred that each user-selectable coupling feature 60 is formed in, on, or connected to a different lever or a different scissor linkage included within selectorized lever assembly 38. For example, each user-selectable coupling feature 60 is conveniently formed as a longitudinal channel through a different central rivet 54, and therefore a different scissor linkage 52 included within selectorized lever assembly 38, as generally indicated in FIG. 2.

As previously stated, user-manipulated element 32 is mechanically linked to selectorized lever assembly 38 via cable 44. As a user-manipulated element 32 is moved by a user during the performance of an exercise, selectorized lever assembly 38 moves along an extension/retraction axis 70 (FIG. 2) between a retracted or non-extended position (FIG. 1) and an extended position (FIG. 2). Thus, scissor linkages 52 can be described as a kinematic chain having a single degree of freedom. In a preferred group of embodiments, the movement of the levers 56, 58 included within selectorized lever assembly 38 is mechanically synchronized. Thus, with reference to FIG. 2, any appreciable movement of a given lever (or of a given scissor linkage 52) within selectorized lever assembly 38 will result in the substantially simultaneous movement of the other levers (or other scissor linkages 52) within lever assembly 38, excluding minimal play within the assembly joints. Furthermore, as selectorized lever assembly 38 moves along extension/retraction axis 70, each user-selectable coupling feature or channel 60 travels along a generally linear path that is substantially parallel to axis 70. The path traveled by each user-selectable coupling feature or channel 60 is preferably substantially parallel with the paths traveled by the other channels 60 and, more preferably, substantially co-linear with the paths traveled by the other channels 60. When the selectorized lever assembly 38 resides in the non-extended position shown in FIG. 1, user-selectable coupling features or channels 60 reside relatively close to one another. As selectorized lever assembly 38 moves toward the extended position shown in FIG. 2, the spacing between user-selectable coupling features or channels 60 increases as channels 60 disperse along extension/retraction axis 70. Also, when selectorized lever assembly 38 extends along extension/retraction axis 70, each user-selectable coupling feature or channel 60 travels a different distance with respect to the feature's staring position and with respect to the location at which lever assembly 38 is mounted to support structure 34. By confining the movement of selectorized lever assembly 38 such that coupling features 60 travel along substantially linear or substantially co-linear paths, and in contrast to resistance devices employing a single, relatively lengthy, unitary lever, the manner in which lever-load adapter 46 interfaces with coupling features 60 can be simplified (e.g., lever-load adapter 46 can be positioned adjacent lever assembly 38 and can travel therewith along a substantially linear path, as described more fully below), selectorized lever assembly 38 can be fit into a high aspect ratio spatial envelope similar to that occupied by a weight stack, the range of motion of coupling features 60 can be maximized, and, when selectorized lever assembly 38 is oriented such that assembly 38 extends in a generally upward or downward direction, the footprint of selectorized lever assembly 38 can be minimized.

As shown in FIG. 1, exemplary lever-load adapter 46 assumes the form of an elongated plate-like body having a number of apertures 66 formed therethrough (only one of which is labeled in FIG. 1). When in the resting position (FIG. 1), lever-load adapter 46 resides adjacent selectorized lever assembly 38, and each aperture 66 aligns with a different channel 60 formed through lever assembly 38 (identified in FIG. 2). Each aperture 66 preferably has an inner diameter substantially equivalent to the inner diameter of each channel 60. Furthermore, the inner diameters of apertures 66 and channels 60 are each preferably slightly larger than is the outer diameter of the elongated body of a conventional selector pin, such as selector pin 68 shown in FIG. 1. When exercise machine 30 is in the resting position (FIG. 1), a user can insert selector pin 68 through a chosen aperture 66 provided in lever-load adapter 46 and into the corresponding channel 60 provided through lever assembly 38 to mechanically couple lever-load adapter 46 and, therefore, input load 48 to a chosen user-selectable coupling feature or channel 60 (indicated in FIG. 1 by dashed lines 71). In this manner, selectorized lever assembly 38 cooperates with input resistance assembly 40 to form a pin insertion interface that mimics the well-known and intuitive user interface employed by conventional stacked weight exercise machines. Notably, user-selectable coupling features 60 are mutually exclusive; that is, selectorized lever assembly 38 is prevented from extending if more than a single user-selectable coupling feature 60 is coupled to input resistance assembly 40 at a given juncture.

Figure 3:
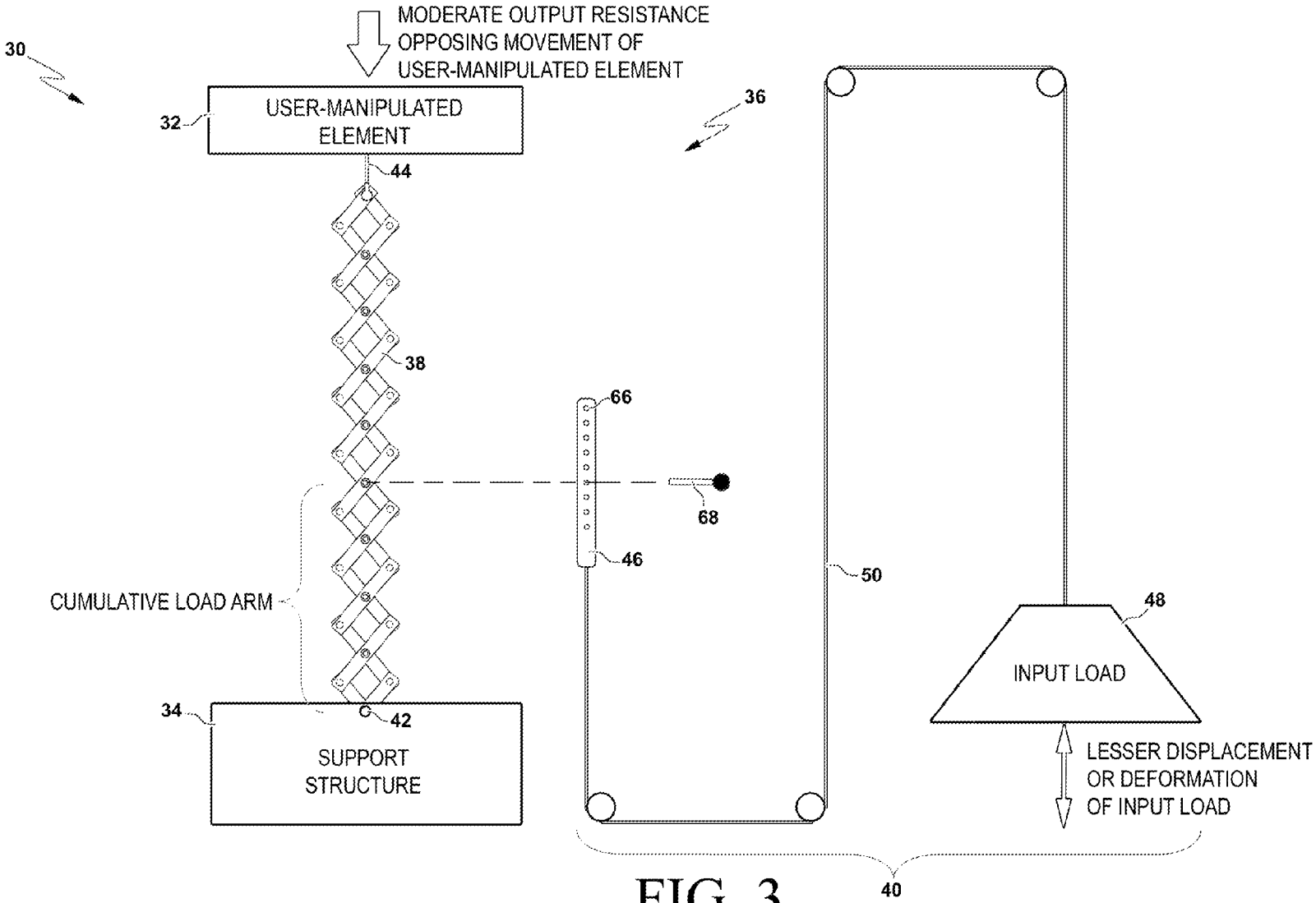
FIGS. 3 and 4 illustrate generalized exercise machine shown in FIGS. 1 and 2 in a non-resting position after a user has selected a moderate output resistance and a high output resistance, respectively.
Figure 4:
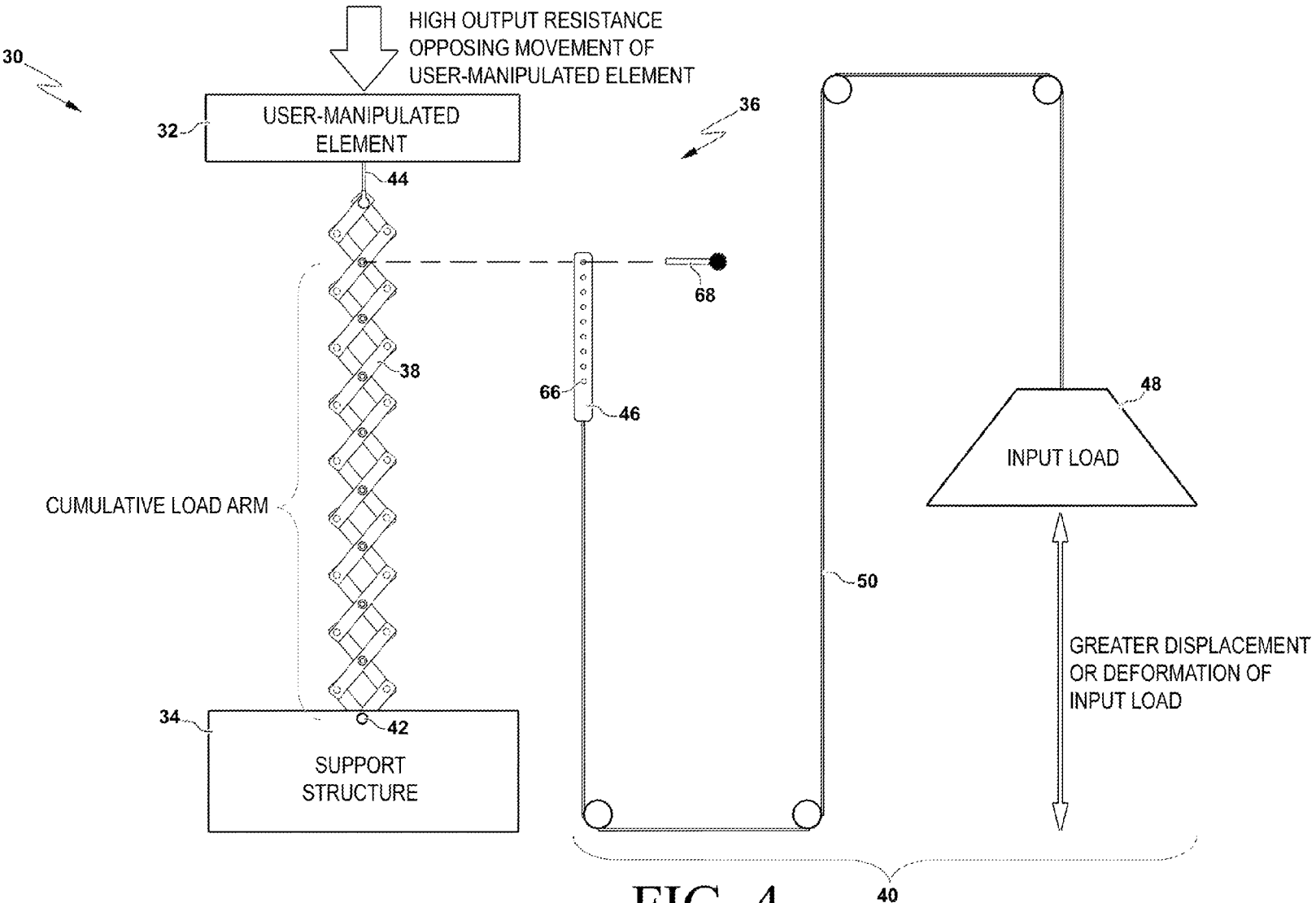

FIGS. 3 and 4 illustrate exercise machine 30 in a non-resting or active position after a user has moved user-manipulated element 32 a predetermined distance during the performance of an exercise and, specifically, during the concentric phase of a repetition in an exercise set. As a result of the movement of user-manipulated element 32, selectorized lever assembly 38 has been pulled into an extended position. Although user-manipulated element 32 has been moved the same distance in the scenarios illustrated in FIGS. 3 and 4, the resistive output force that opposed movement of user-manipulated element 32 varied depending upon the particular coupling feature or channel 60 previously coupled to input resistance assembly 40 via the insertion of selector pin 68. In the scenario illustrated in FIG. 3, the user was required to overcome a moderate resistive output force to move user-manipulated element 32 into the illustrated position; while in the scenario illustrated in FIG. 4, the user was required to overcome a relatively high resistive output force. The mechanism by which user-adjustable resistance mechanism 36 enables multiple output forces to be derived from the single predetermined input resistance (or range of input resistances) supplied by input load 48 is described in detail below.

During usage of exercise machine 30, selectorized lever assembly 38 functions as a second class lever wherein: (i) the location of the input effort is fixed at the location at which user-manipulated element 32 is mechanically coupled to selectorized lever assembly 38 (the uppermost end portion of lever assembly 38 in the illustrated example); (ii) the location of primary fulcrum is fixed at the location at which selectorized lever assembly 38 is mounted to support structure 34 (the lowermost end portion of lever assembly 38 in the illustrated example); and (iii) the location of the lever load varies in conjunction with the location at which input resistance assembly 40 and, specifically, input load 48 is most directly mechanically coupled to selectorized lever assembly 38 via insertion of selector pin 68. For this reason, the mechanism by which user-adjustable resistance mechanism 36 produces different output resistances from input load 48 is conveniently described in terms of a variable cumulative load arm; i.e., the total effective lever length between primary fulcrum 42 and the user-selected location of the lever load, as taken along series-coupled levers 56 (FIG. 2) or as taken along series-coupled levers 58 (FIG. 2). In the scenario illustrated in FIG. 3, the user mechanically coupled input resistance assembly 40 and, specifically, lever-load adapter 46 to an intermediate channel 60 in selectorized lever assembly 38. The cumulative load arm of selectorized lever assembly 38 (taken along either series-coupled levers 56 or along series-coupled levers 58) was consequently chosen to have a moderate length, and a moderate output resistance opposed the movement of user-manipulated element 32 into the position illustrated in FIG. 3. By comparison, in the scenario illustrated in FIG. 4, the user mechanically coupled input resistance assembly 40 and, specifically, lever-load adapter 46 to the uppermost channel 60 in selectorized lever assembly 38. The cumulative load arm of selectorized lever assembly 38 was consequently chosen to be relatively long, and a relatively high output resistance opposed the movement of user-manipulated element 32 into the position illustrated in FIG. 4.

The mechanism by which user-adjustable resistance mechanism 36 produces different output resistances from input load 48 can also be described in terms of mechanical advantage directly. Ideal mechanical advantage (i.e., mechanical advantage excluding friction) is expressed by Equation 1 below:

$$IMA = \frac{D_E}{D_R} \qquad \text{EQ. 1}$$

wherein $D_E$ and $D_R$ represent the effort distance and the resistance distance, respectively. The effort distance ($D_E$) is the distance traveled by the portion of selectorized lever assembly 38 mechanically coupled to user-manipulated element 32 (the uppermost end of lever assembly 38 in the illustrated example). In the simplified example shown in FIGS. 1-4, the distance traveled by the upper end portion of selectorized lever assembly 38 is equivalent to the distance traveled by user-manipulated element 32, although this may not be the case in alternative embodiments employing, for example, a pulley system between assembly 38 and element 32 having a ratio other than 1:1. The resistance distance ($D_R$) is the distance traveled by the user-selectable coupling feature or channel 60 mechanically connected to input resistance assembly 40 via the insertion of selector pin 68. Again, in the simplified example shown in FIGS. 1-4, the resistance distance ($D_R$) is equivalent to the displacement of input load 48, although this may not be the case in alternative embodiments.

The upper portion of selectorized lever assembly 38 is moved equivalent distances in each of the scenarios illustrated in FIGS. 3 and 4. The effort distance ($D_E$) is consequently held constant, and the ideal mechanical advantage (IMA) is inversely proportional to the resistance distance ($D_R$). In the scenario illustrated in FIG. 3, input resistance assembly 40 has been coupled to a user-selectable coupling feature or channel 60 that travels a moderate distance as selectorized lever assembly 38 extends in conjunction with the movement of user-manipulated element 32. As a result, input load 48 undergoes moderate displacement for the given movement of the user-manipulated element 32, selectorized lever assembly 38 provides a moderate mechanical advantage, and the movement of user-manipulated element 32 is opposed by an intermediate output resistance. By comparison, in the scenario illustrated in FIG. 4, input resistance assembly 40 has been coupled to a user-selectable coupling feature or channel 60 that travels the furthest distance as selectorized lever assembly 38 extends in conjunction with the movement of user-manipulated element 32; input load 48 thus undergoes a relatively significant displacement for the given movement of the user-manipulated element 32, selectorized lever assembly 38 provides relatively little mechanical advantage, and the movement of user-manipulated element 32 is opposed by a relatively strong output resistance.

There has thus been provided a generalized example of an exercise machine employing a selectorized lever assembly that enables a user to select a desired output resistance derived from one or more input resistances in a simple and familiar manner, namely, via the insertion of a selector pin. In the above-described exemplary embodiment, selectorized lever assembly 38 extended in an upward direction along an axis substantially normal to the plane of the floor; however, selectorized lever assembly 38 can easily be configured to extend in any direction along any axis or axes in three dimensional space. Similarly, when input load 48 assumes the form of a non-weight-based resistive element, such as one or more springs, one or more elastic bands, a frictional resistance device, a magnetic resistance device, a working-fluid device, or the like, input load 48 may be configured to undergo displacement/deformation along any desired axis or axes. As a specific example, in an embodiment wherein exercise machine 30 assumes the form of a low profile rowing machine and input load 48 assumes the form of one or more springs or elastic bands, selectorized lever assembly 38 and input load 48 can be configured to extend and deform, respectively, along one or more axes substantially parallel to the plane of the floor as a user pulls user-manipulated element 32 toward his or her chest during the concentric phase of a row-type exercise.

Working Example of an Exercise Machine Employing an Embodiment of the User-Adjustable Resistance Mechanism The following provides an exemplary embodiment of the user-adjustable resistance mechanism in the context of a particular type of exercise machine, namely, a dedicated pull-down machine. It is emphasized, however, that embodiments of the user-adjustable resistance mechanism are highly versatile and can be employed in a wide variety of different types of exercise equipment and devices, whether freestanding or user-portable. For example, embodiments of the user-adjustable resistance mechanism can be included within dedicated exercise machines of the type commonly found in commercial gyms (e.g., bench press, shoulder press, leg press, pectoral fly, shoulder raise, rear shoulder, leg extension, leg curl, oblique, abdominal, hip adduction, hip abduction, pull-over, assisted dip, assisted pull-up, calf raise, and neck exercise machines, to list but a few). In addition, the adjustable resistance mechanism is well-suited for use within multi-station gyms, rowing machines, functional trainers, fixed and adjustable cable pulley machines, and other pieces of exercise equipment intended for commercial, light commercial, or non-commercial use. As a still further example, the adjustable resistance mechanism can be employed in body suspension-type exercise devices and other exercise devices utilized during physical therapy.

Figure 5:
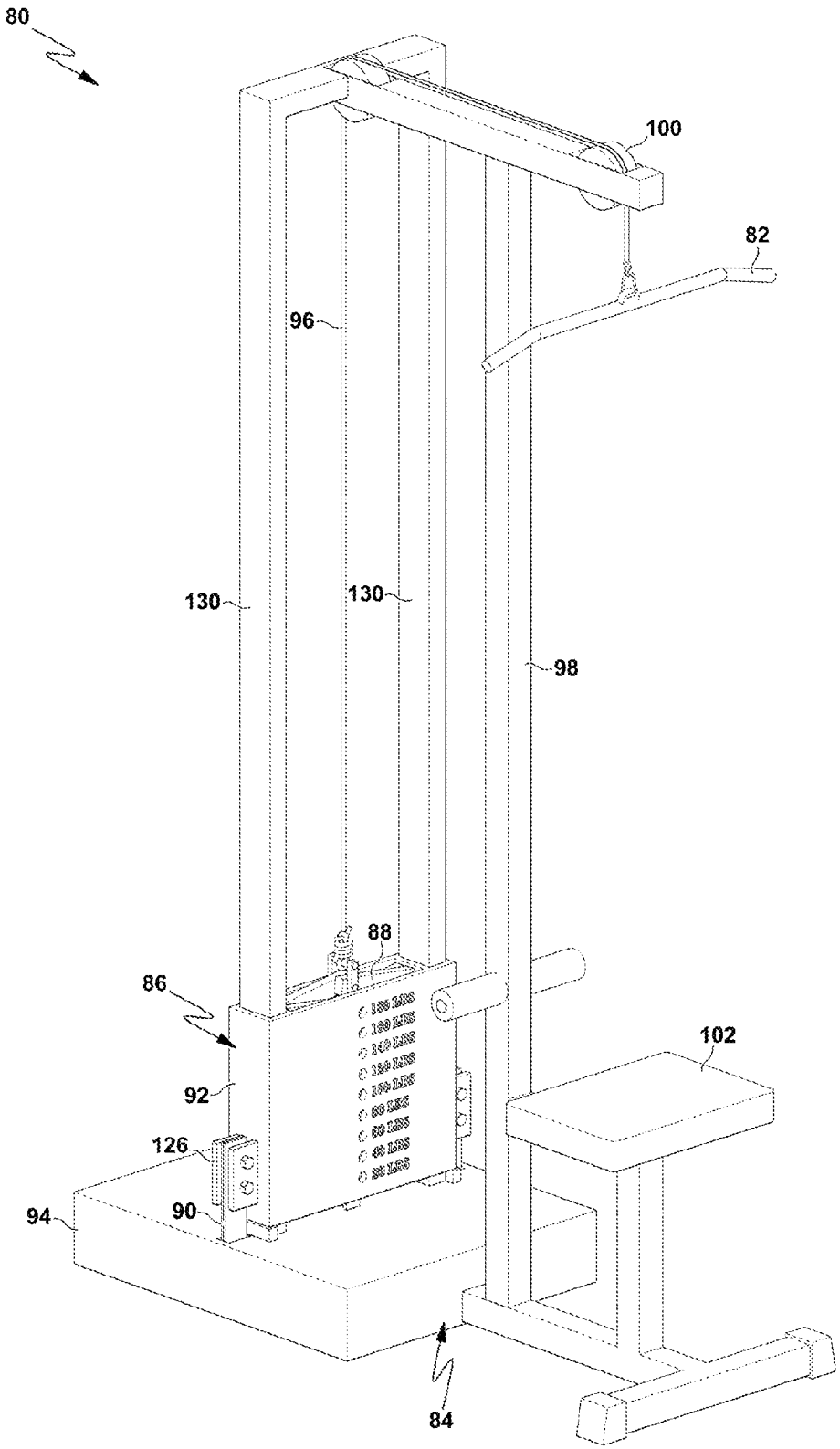
FIG. 5 is an isometric view of an exercise machine in a resting position in accordance with a second exemplary embodiment.

FIG. 5 is an isometric view of an exercise apparatus or machine 80 in accordance with a second exemplary embodiment of the present invention. Exercise machine 80 comprises a user-manipulated element 82, a support structure 84, and a user-adjustable resistance mechanism 86. User-adjustable resistance mechanism 86, in turn, includes a selectorized lever assembly 88, an input load 90, and a lever-load adapter 92. Input load 90 and lever-load adapter 92 cooperate to form an input resistance assembly 90, 92. At their lower ends, selectorized lever assembly 88 and input resistance assembly 90, 92 are each mounted to a base 94 included within support structure 84. An upper end portion of selectorized lever assembly 88 is further mechanically coupled to user-manipulated element 82. In the illustrated example, selectorized lever assembly 88 is mechanically coupled to user-manipulated element 82 via a flexible link, namely, a cable 96. In addition to base 94, support structure 84 includes a frame 98, a simple pulley system 100, and a seat 102. Support structure 84 may also include various combinations of linkages, beams, rails, pulleys, cables, belts, cams, levers, locking mechanisms (e.g., spring-loaded plungers), joints, and other structural elements of the type commonly combined to produce a workout station. Support structure 84 is, of course, presented by way of simplified example only; the components included within support structure 84 and the manner which the components are arranged will inevitably vary amongst different embodiments of exercise machine 80.

Figure 6:
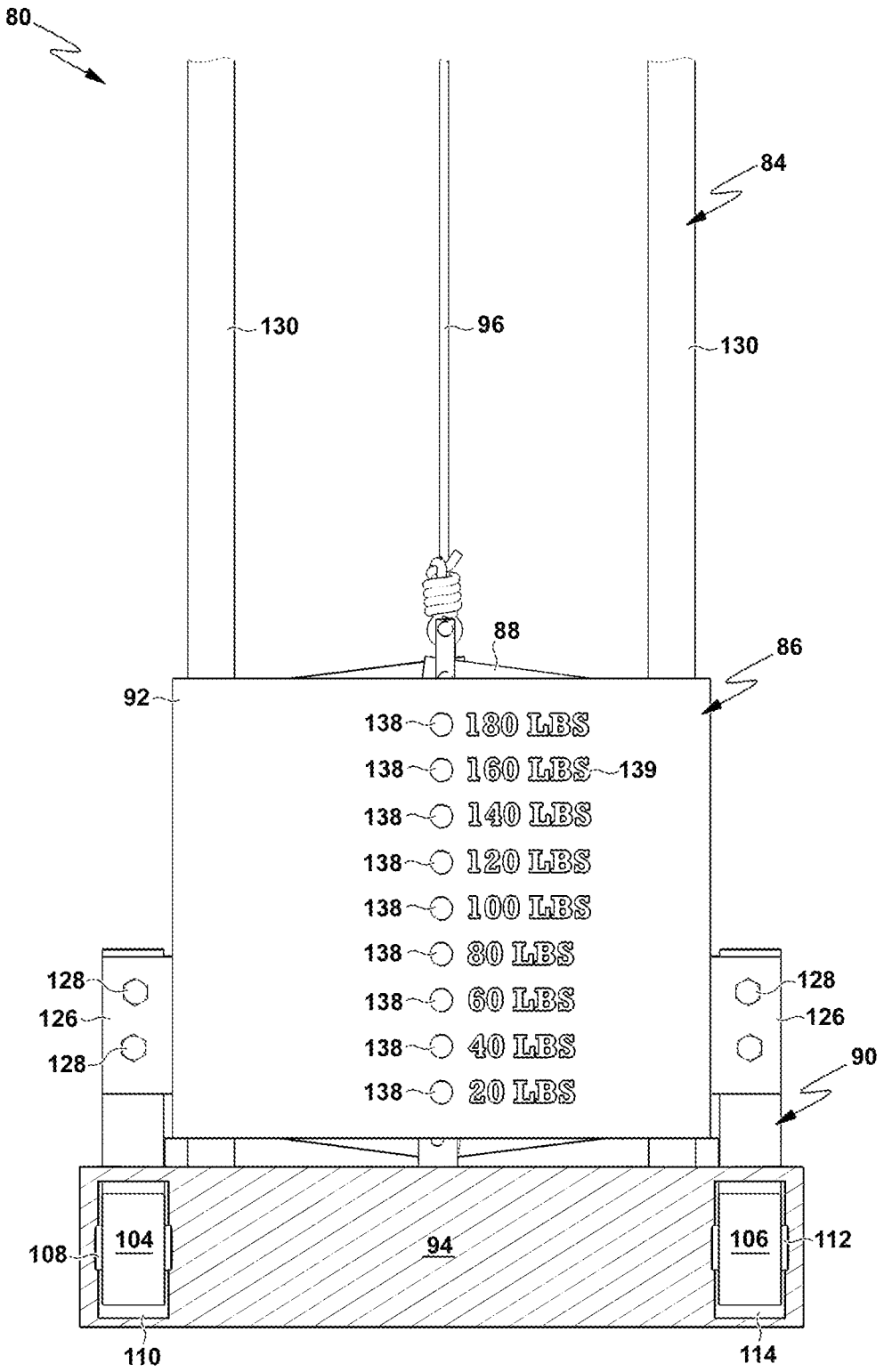
FIGS. 6 and 7 are front and side isometric views, respectively, of the base (shown in cross-section) and the user-adjustable resistance mechanism included within the exercise machine shown in FIG. 5.
Figure 7:
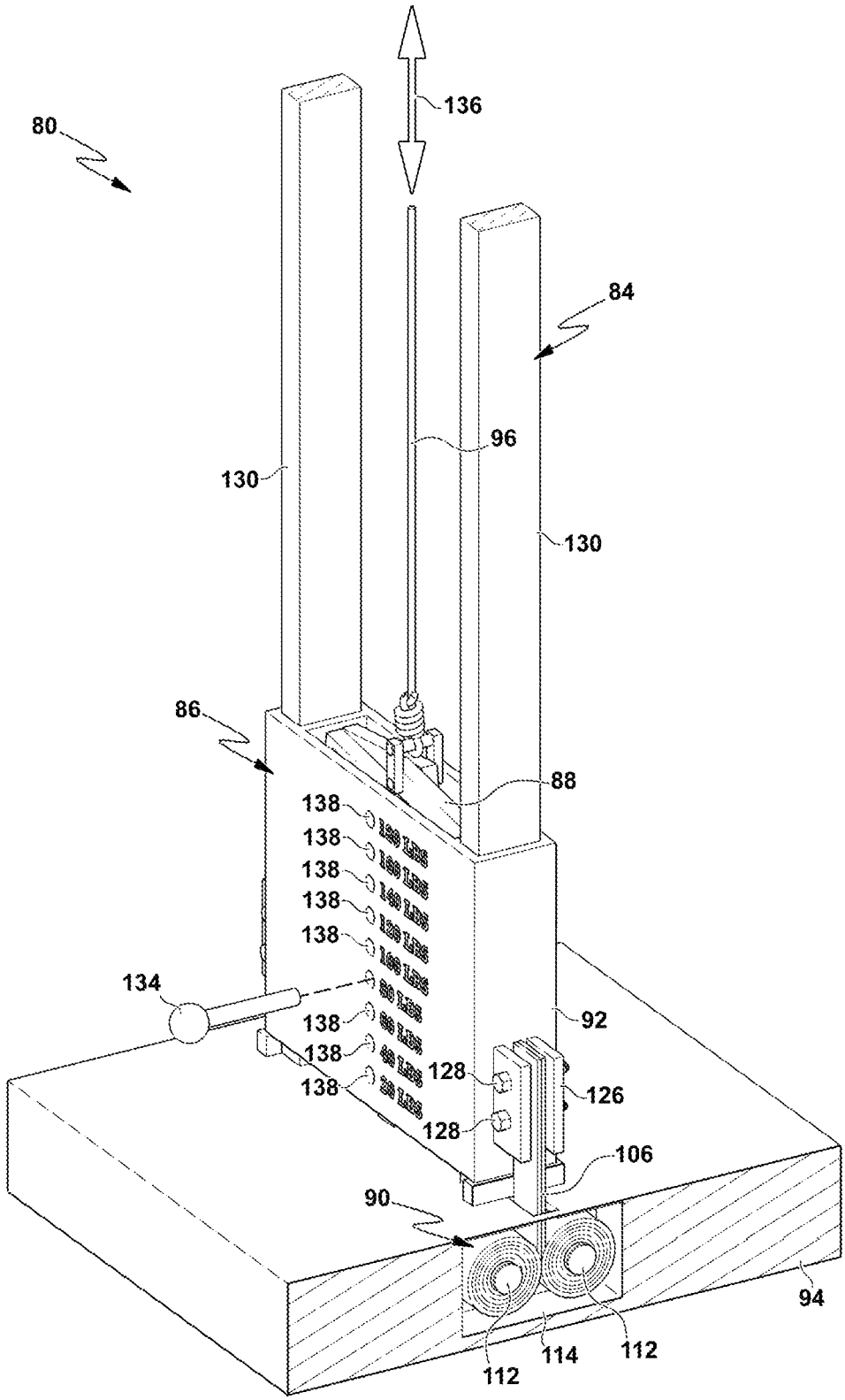

FIGS. 6 and 7 are front and side isometric views, respectively, of base 94 (shown in cutaway in FIG. 6 and in FIG. 7) and user-adjustable resistance mechanism 86 illustrating input load 90 in greater detail. In this particular example, input load 90 comprises a plurality of resilient devices, namely, first and second pairs of constant force extension spring assemblies 104 and 106. In one specific embodiment, each spring assembly 104 and 106 comprises multiple constant force springs interwound in a laminar mounting. Constant force extension spring assemblies are generally well-suited for use as input load 90 as such assemblies are lightweight and capable of providing a substantially constant resistive force profile (after initial deflection) opposing the movement of user-manipulated element 82 over the full range of motion of element 82. However, constant force extension spring assemblies are limited in certain respects; e.g., at higher life cycles and higher resistances, such spring assemblies tend to be more costly than other resilient resistive means, such as elastic bands. For this reason, constant force extension spring assemblies 104 and 106 may be replaced by first and second elastic bands or other resilient elements in alternative embodiments of exercise machine 80.

As shown in FIG. 6, constant force extension spring assembly 104 may be mounted around two bushings or drums 108 (only one which can be seen in FIG. 6), which reside in a first cavity 110 provided in base 94. Similarly, as shown in FIGS. 6 and 7, constant force extension spring assembly 106 may be mounted around two bushings or drums 112, which reside in a second cavity 114 provided in base 94. The free ends of constant force spring assemblies 104 and 106 extend away from drums 108 and 112, respectively, and are fixedly coupled to lever-load adapter 92. More specifically, the free ends of constant force spring assemblies 104 and 106 extend upward from base 94 and are each fixedly coupled to a different pair of tabs 126 projecting from opposing side portions of lever-load adapter 92 utilizing, for example, a plurality of bolts 128. For added stability, constant force extension spring assemblies 104 and 106 are preferably mounted in a back-to-back configuration; however, other mounting configurations may be employed, including tandem mounting, laminatemounting, and/or pulley-mounting configurations. Input load 90 is chosen in relation to the desired resistance characteristics of exercise machine 80. In the case of constant force extension spring assemblies 104 and 106, the dimensions (e.g., thickness and width), output torque, material (e.g., stainless steel, high-carbon spring steel, etc.), and other aspects of spring assemblies 104 and 106 will depend upon many factors affecting the overall resistive output force produced at user-element manipulated 82. These factors include the dimensions of the levers employed in selectorized lever assembly 88, the weight of selectorized lever assembly 88, the weight of lever-load adapter 92, frictional system losses, the outer diameter of the bushing(s) or drum(s) around which the constant force extension spring assemblies 104 and 106 are coiled, and other such design parameters.

As noted above, an upper end portion of selectorized lever assembly 88 is coupled to user-manipulated element 82 via cable 96, and a lower end portion of selectorized lever assembly 88 is rotatably mounted to base 94. The upper end portion of selectorized lever assembly 88 is thus mechanically linked to user-manipulated element 82 and moves therewith as a user moves element 82 during the performance of an exercise; e.g., the upper end portion of selectorized lever assembly 88 may extend away from or retract toward base 94 along an extension/retraction axis (represented in FIG. 7 by double-headed arrow 136) as a user moves element 82. When exercise machine 80, and more specifically user-manipulated element 82, is in a resting position, selectorized lever assembly 88 resides in the non-extended or retracted position shown in FIGS. 5-7 and 9. When user-manipulated element 82 has been moved by a user during the performance of an exercise (in particular, during the concentric phase of a single repetition in an exercise set), selectorized lever assembly 88 transitions toward an extended position as described below in conjunction with FIGS. 11 and 12. Due to the movement of selectorized lever assembly 88, the end portion of lever assembly 88 coupled to user-manipulated element 82 (the upper end portion in the illustrated orientation) may be referred to as the lever assembly's "fully articulating end portion" herein below, and the end portion of lever assembly 88 mounted to support structure 84 (the lower end portion in the illustrated orientation) may be referred to as the lever assembly's "anchored end portion" herein below.

Figure 8:
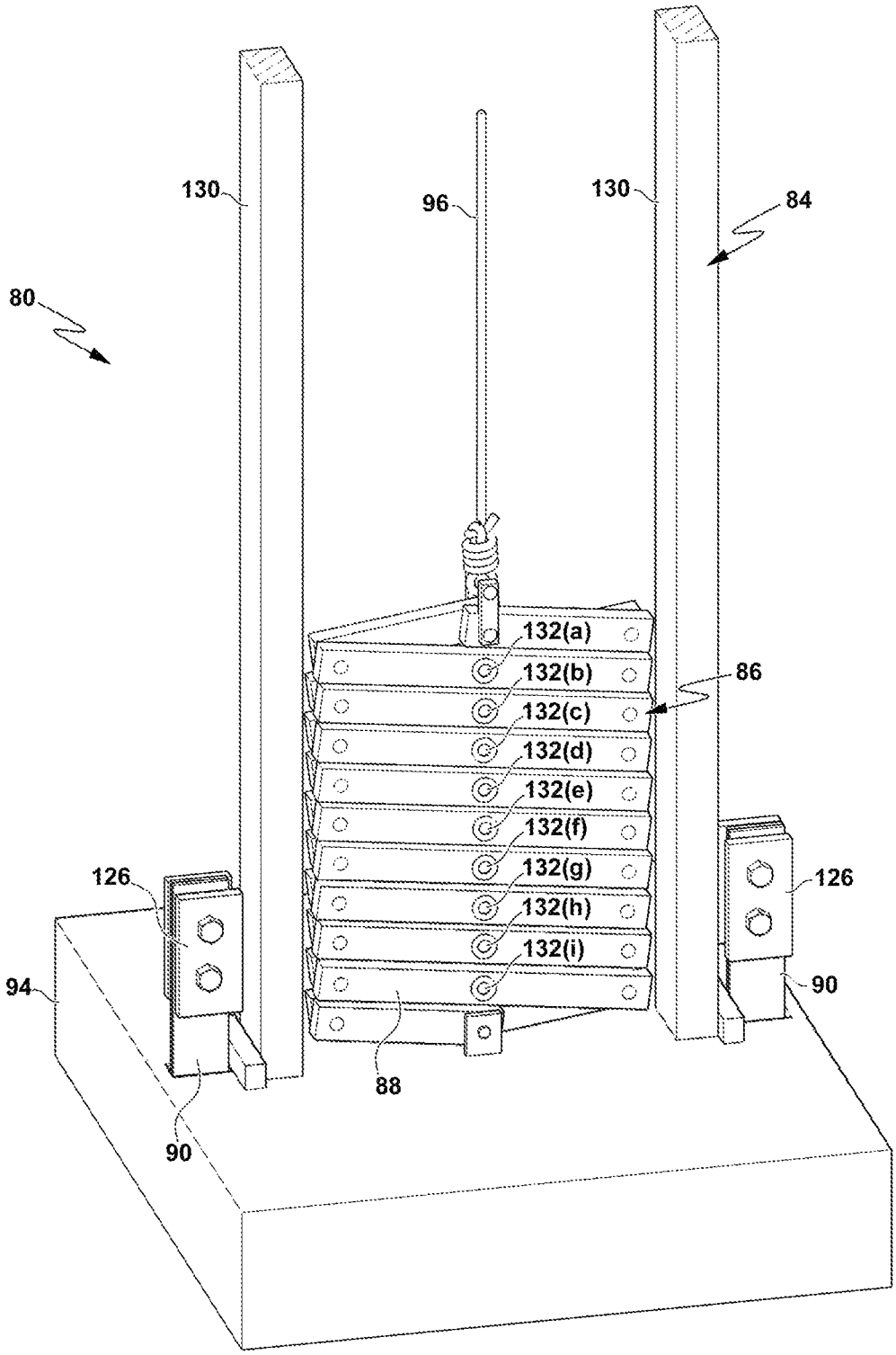
FIGS. 8 and 9 are front and rear isometric views, respectively, of the user-adjustable resistance mechanism shown in FIGS. 5-7 with the lever-load adapter hidden from view.
Figure 9:
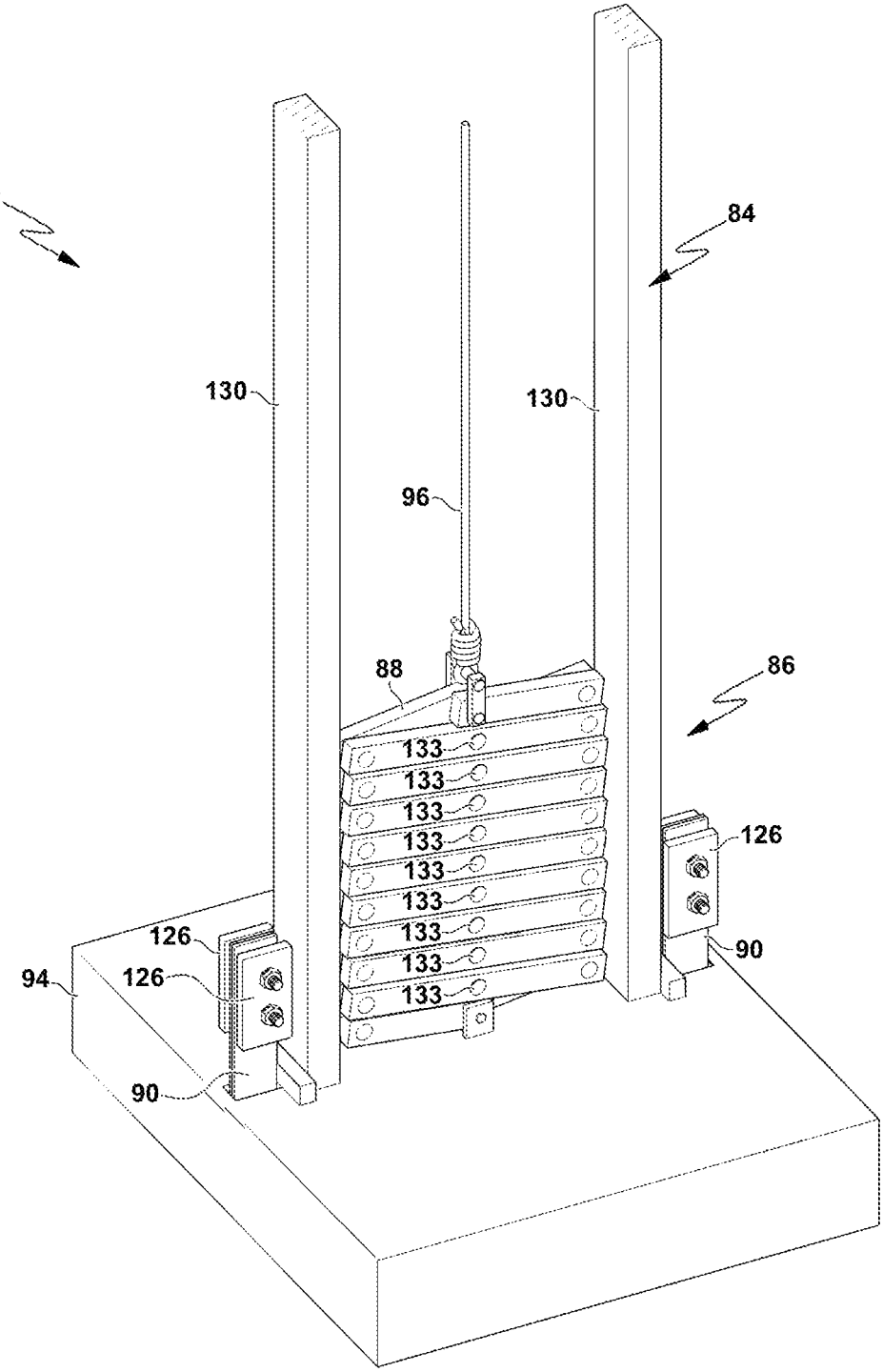

FIGS. 8 and 9 are front and rear isometric views, respectively, of the lower portion of exercise machine 80 having lever-load adapter 92 removed for clarity. As can be seen in FIGS. 8 and 9, selectorized lever assembly 88 includes a first plurality of levers and a second plurality of levers, which are each rotatably coupled in series between user-manipulated element 82 and base 94 of support structure 84. The first and second series-coupled levers are rotatably joined in parallel by a plurality of fasteners (e.g., rivets) to form a plurality of scissor linkages (the fasteners shown in FIG. 8 and hidden from view in FIG. 9 to show the central apertures 133 through which the fasteners are disposed). Each central fastener (FIG. 8) includes a longitudinal channel 132 therethrough, which has an inner diameter that is slightly greater than the outer diameter of the body of a selector pin 134 (shown in FIG. 7). Pin 134 can thus be inserted into a selected channel 132 to mechanically connect lever-load adapter 92, and therefore input load 90, to a selected portion or segment of lever assembly 88 as described more fully below.

Figure 10:
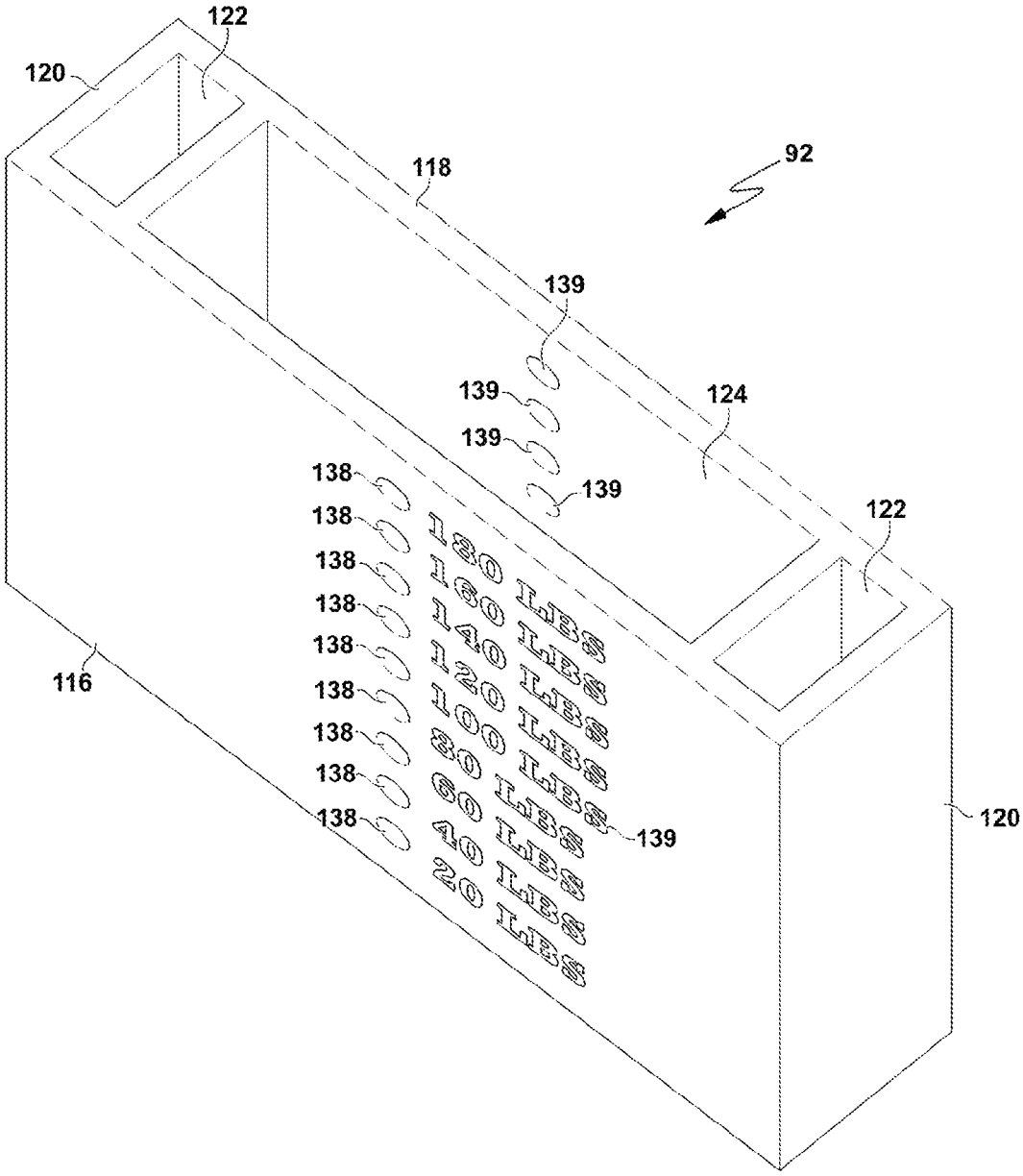
FIG. 10 is an isometric view of the exemplary lever-load adapter included in the exercise machine shown in FIGS. 5-7.

FIG. 10 is an isometric view illustrating lever-load adapter 92 in greater detail (tabs 126 not shown). As can be seen in FIG. 10, lever-load adapter 92 includes a front plate portion 116, a rear plate portion 118, and two tubular side portions 120 each having a longitudinal guide channel 122 therethrough. Front plate portion 116, rear plate portion 118, and tubular side portions 120 cooperate to form a box-like structure having a central cavity or tunnel 124, which is exposed through the upper and lower ends of lever-load adapter 92. Referring collectively to FIGS. 5-10, when exercise machine 80 is assembled, selectorized lever assembly 88 extends through central tunnel 124 of adapter 92 (FIG. 10). Tubular side portions 120 of adapter 92 (FIG. 10) are each slidably coupled to frame 98; in particular, frame 98 includes first and second guide rails 130 (FIGS. 5-9), which extend upwardly from base 94 through channels 122 provided through tubular side portions 120 of lever-load adapter 90. During usage of exercise machine 80, lever-load adapter 92 moves in conjunction with selectorized lever assembly 88 (when coupled thereto) along an axis substantially parallel to extension/retraction axis 136 by sliding vertically along guide rails 130. If desired, a low friction material or linear bearings (not shown) may be disposed between an interior surface of tubular side portions 120 and an exterior surface of guide rails 130 to decrease friction as lever-load adapter 92 moves vertically along guide rails 130.

With continued reference to FIGS. 5-10, and with specific reference to FIG. 10, front plate portion 116 of lever-adapter 90 has a first plurality of apertures 138 therethrough. Similarly, rear plate portion 118 includes a second plurality of apertures 139 therethrough, which align with apertures 138. Aperture 138 and 139 each have an inner diameter that is slightly greater than the outer diameter of the body of pin 134. When exercise machine 80 is in the non-extended position, each of apertures 138 and each of apertures 139 align with a different lever assembly channel 132. Thus, to mechanically couple input load 90 to a desired channel 132, a user can simply insert selector pin 134 (FIG. 7) into a chosen aperture 138 in front plate portion 116 corresponding to the desired channel 132. When inserted into a chosen aperture 138 in front plate portion 116, pin 134 extends through front plate portion 116, through the corresponding lever assembly channel 132 formed in selectorized lever assembly 88, and into rear plate portion 118. This selection interface mimics that employed by traditional stacked weight exercise machines. In addition, by receiving selector pin 134 through an aperture 138 in front plate portion 116, through the corresponding lever assembly channel 132, and through the corresponding aperture 139 in rear plate portion 118, the input load is transferred from input resistance assembly 90, 92 to selectorized lever assembly 88 along a structurally robust and balanced force transmission path. As indicated in FIG. 6 at 139, graphics may be provided on front plate portion 118 to indicate the approximate resistive force that may be produced by user-adjustable resistance mechanism 86 during use when selector pin 134 is inserted into the various apertures 138 provided through front plate portion 118.

Figure 11:
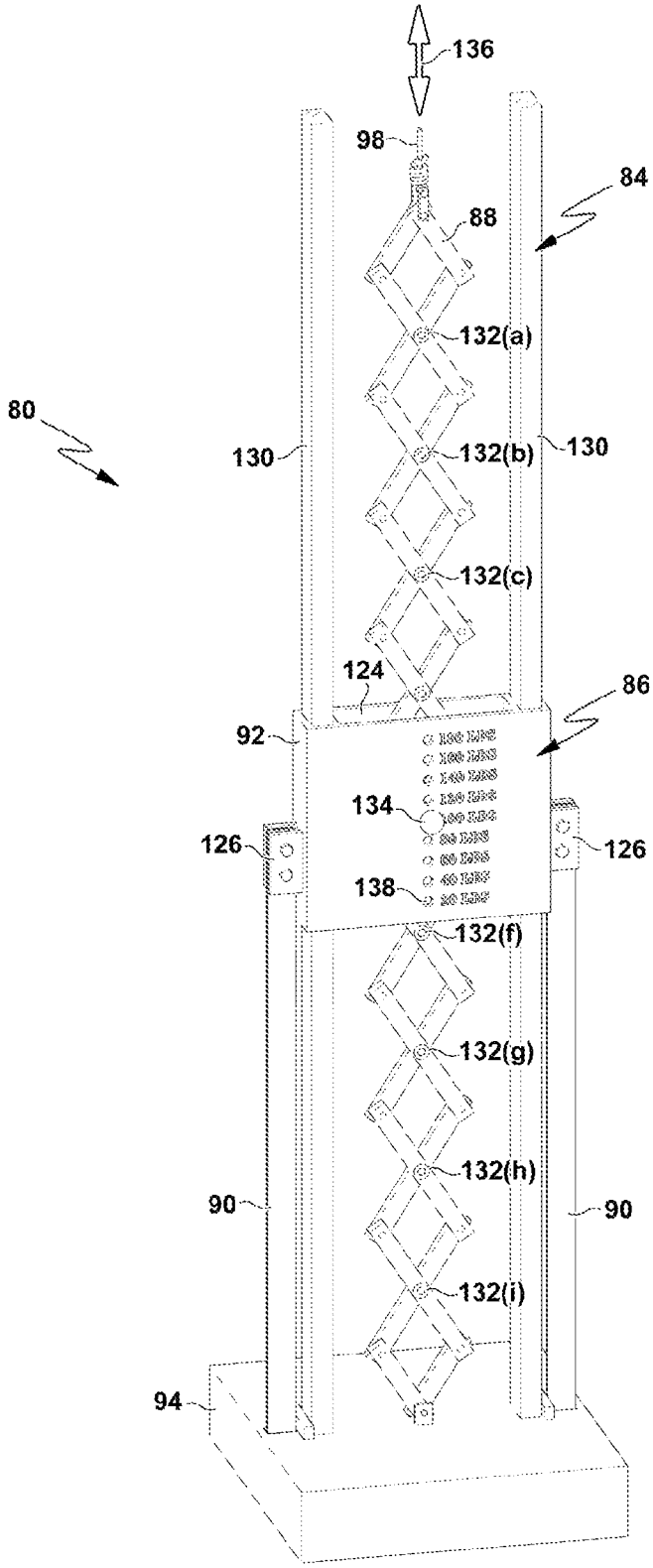
FIGS. 11 and 12 are isometric views of the exercise machine shown in FIGS. 5-9 in a non-resting position after a user has selected a moderate output resistance and a high output resistance, respectively.
Figure 12:
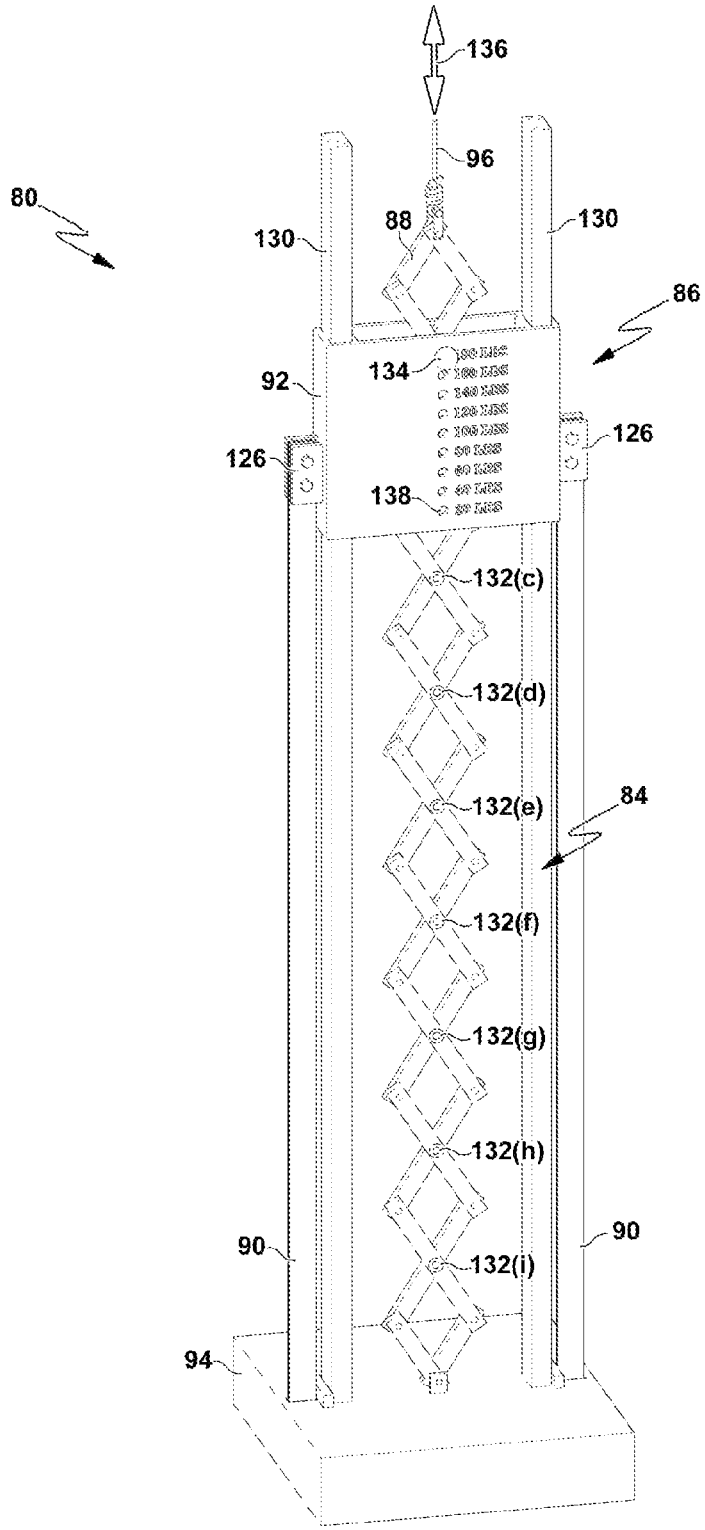

FIGS. 11 and 12 are plan views of exercise machine 80 illustrating the movement of user-adjustable resistance mechanism 86 at intermediate and high resistances, respectively. In FIGS. 11 and 12, the upper portion of selectorized lever assembly 88 has been pulled upward by cable 96 as user-manipulated element 82 (FIG. 5) has been moved by a user. The extension of selectorized lever assembly 88 results in the dispersal of lever assembly channels 132 along extension/retraction axis 136. Channels 132 each travel a different distance (relative to their starting positions and relative to base 94) for a given movement of user-manipulated element 82. For example, channel 132(*a*) (identified in FIGS. 8 and 11), which normally resides at the location furthest from base 94, travels the furthest distance when lever assembly 88 extends in conjunction with the movement of user-manipulated element 82 (FIG. 5); while channel 132(*i*), which normally resides at the location closest to base 94, travels the shortest distance. Stated differently, when lever assembly 88 extends, channel 132(*i*) travels a shorter distance than does channel 132(*h*), channel 132(*h*) travels a shorter distance than does channel 132(*g*), channel 132(*g*) travels a shorter distance than does channel 132(*f*), and so on. In a preferred embodiment, each channel 132 travels along a substantially linear path that is generally parallel with extension/retraction axis 136 and, perhaps, generally co-linear with the paths traveled by the other channels formed through assembly 88.

Considering the foregoing paragraph, it should be appreciated that the distance of travel for lever-load adapter 92, and therefore the displacement of input load 90, is dependent upon the particular lever assembly channel 132 to which lever-load adapter 92 has been coupled via the insertion of selector pin 134; channels 132 thus serves as "user-selectable coupling features" in this particular example. In the scenario illustrated in FIG. 11, a user has inserted selector pin 134 into lever assembly channel 132(*e*) (identified in FIGS. 8 and 12) and through a corresponding aperture 138 provided in front plate portion 116. Lever assembly channel 132(*e*) travels an intermediate distance as selectorized lever assembly 88 extends in conjunction with movement of user-manipulated element 82 (FIG. 5). Thus, by connecting lever-load adapter 92 to lever assembly channel 132(*e*), the user has determined that the distance of travel for lever-load adapter 92, and therefore the deformation of input load 90, will be moderate for a given movement of user-manipulated element 82. As a result, the output resistance produced by input resistance assembly 90, 92 opposing the movement of user-manipulated element 82 will also be moderate. By comparison, in the scenario illustrated in FIG. 12, pin 134 has been inserted into lever assembly channel 132(*a*) (identified in FIGS. 8 and 11), which travels the furthest distance away from base 94. Thus, by connecting lever-load adapter 92 to lever assembly channel 132(*e*), the user has determined that the distance of travel for lever-load adapter 92, and therefore the deformation of input load 90, will be relatively large for a given movement of user-manipulated element 82. As a result, the output resistance produced by input resistance assembly 90, 92 opposing the movement of user-manipulated element 82 will be correspondingly large.

Although, in the instant exemplary embodiment, selectorized lever assembly 88 is configured such that the further-traveling coupling feature (i.e., feature 132(*a*)) is the uppermost coupling feature and shortest-traveling coupling feature (i.e., feature 132(*i*)) is the lowermost coupling feature, it should be appreciated that this need not always be the case; exercise machine 80 may be configured such that selectorized lever assembly 88 extends in any desired direction. Furthermore, although the disparity in the travel of each channel 132 is substantially constant in the illustrated embodiment (i.e., channel 132(*i*) travels a distance of X, channel 132(*h*) travels a distance of approximately 2×, channel 132(*g*) travels a distance of approximately 3×, etc.), this may be altered as desired by utilizing levers or scissor linkages of varying lengths.

A second exemplary embodiment of an exercise machine employing the inventive selectorized lever assembly has thus been described above in conjunction with FIGS. 5-12. In the above-described exemplary embodiment, the selectorized lever assembly cooperates with the input resistance assembly to emulate the intuitive, pin-insertion selection interface employed by traditional stacked-weight exercise machines. In a functional sense, the selectorized lever assembly permits a user to select one of a plurality of output resistances derived from a single predetermined input resistance or a range of input resistances provided by the input load. The input load may assume any form suitable for applying at least a singe input resistance to the lever assembly. As the particular form assumed by the input load will inevitably vary amongst different embodiments of the present invention, so too will the form taken by the user-selectable coupling features and the support structure. The following describes additional exemplary forms that may be assumed by the plurality of user-selectable coupling features and the selectorized lever assembly.

Additional Examples of the Plurality of User-Selectable Coupling Features

Figure 13:
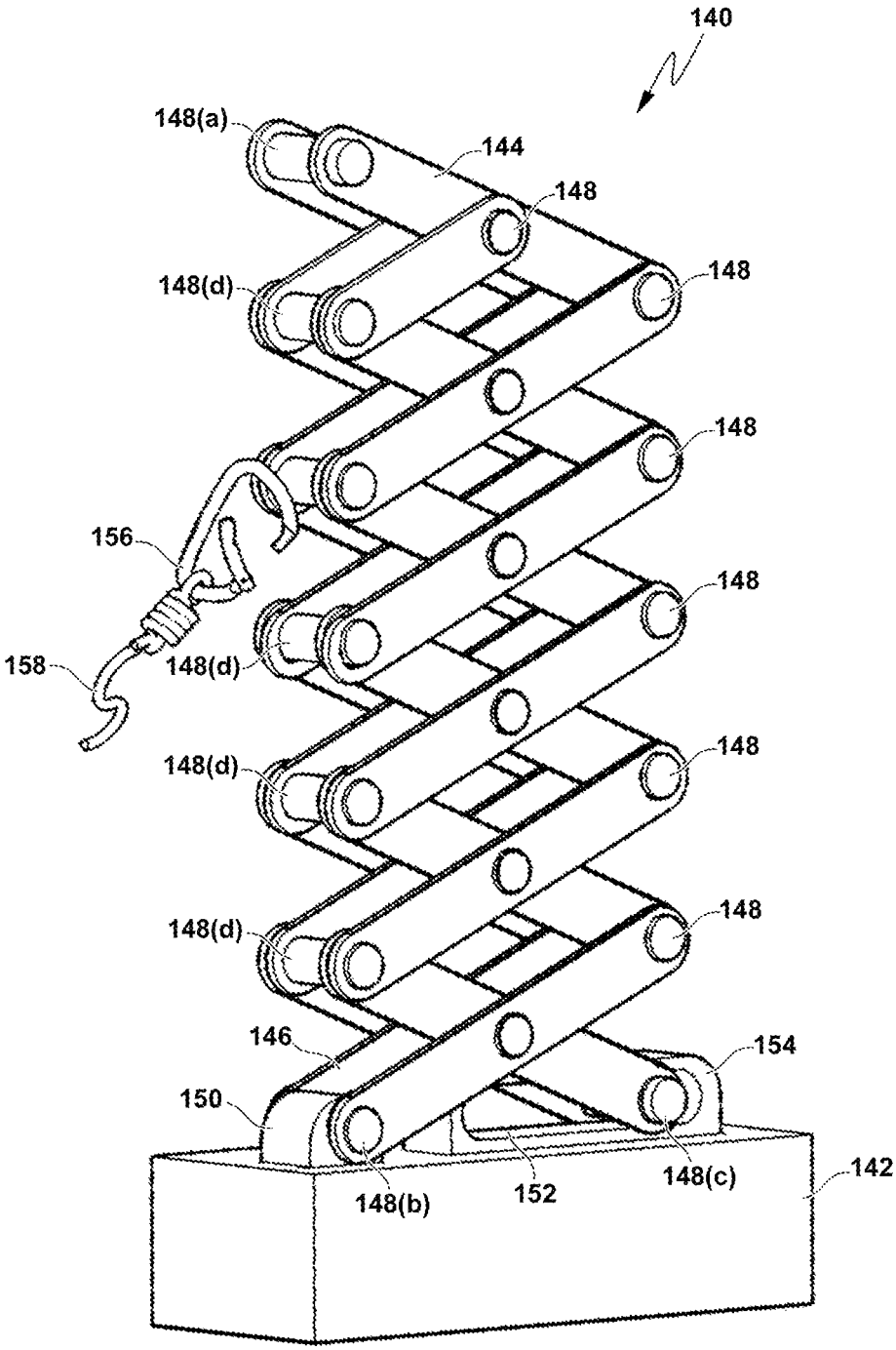
FIGS. 13 and 14 are side and bottom isometric views, respectively, of a selectorized lever assembly in accordance with a third exemplary embodiment.
Figure 14:
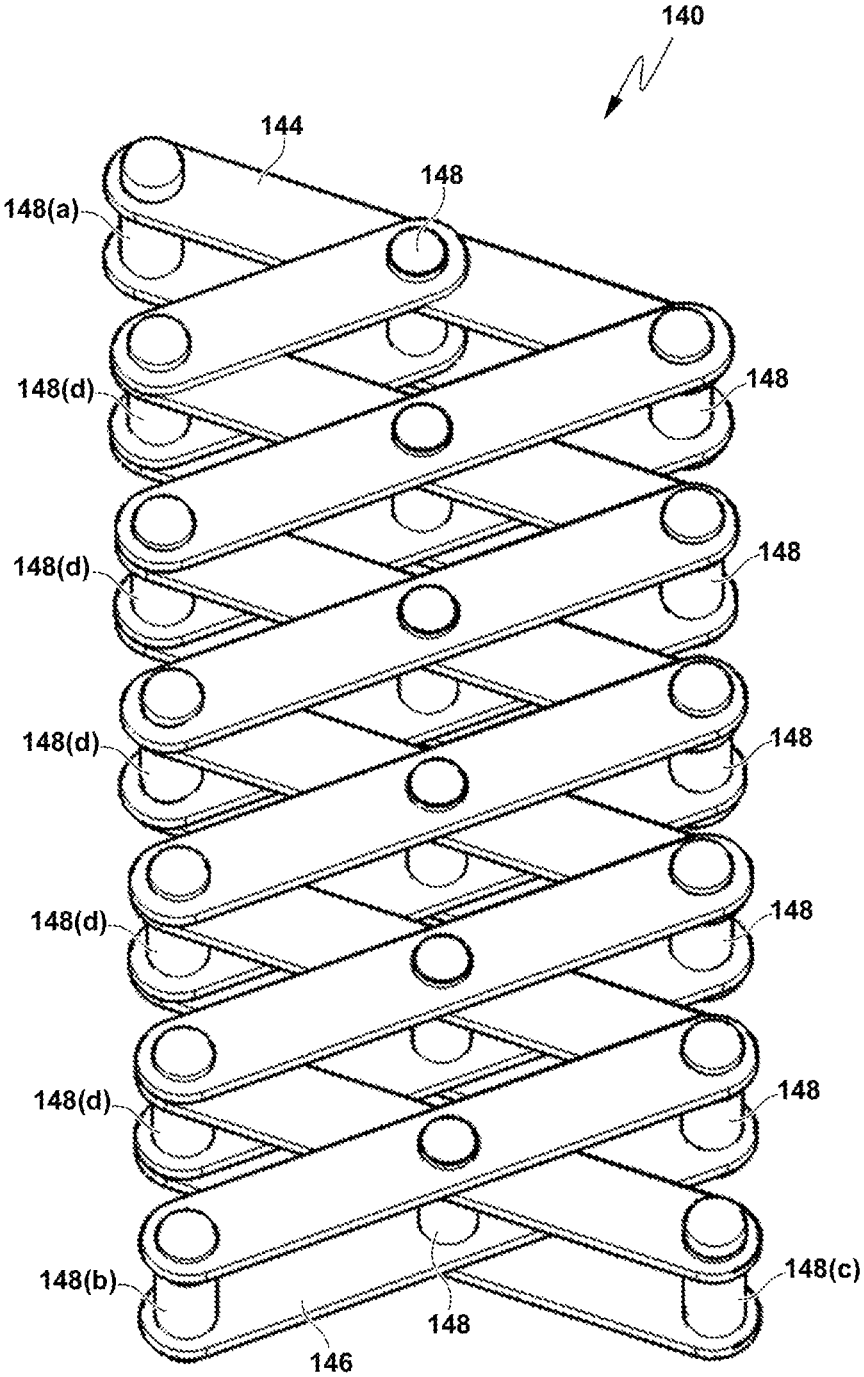

Although the foregoing has described a selectorized lever assembly having a plurality of user-selectable coupling features comprising a series of channels formed in a central portion of the selectorized lever assembly, the user-selectable coupling features may assume other structural forms and may be disposed at other locations on or in the selectorized lever assembly. As a first example, in the exemplary embodiment described above in conjunction with FIGS. 5-12, the plurality of user-selectable coupling features can also be formed as a plurality of translating shelves or ledges that abut a lower surface of the selector pin when pin is inserted into a desired aperture in the lever-load adapter and force the selector pin, and therefore the lever-load adapter, along an extension/retraction axis during extension of the selectorized lever assembly. As a second example, the plurality of user-selectable coupling features may assume the form of projections (e.g., posts, rungs, loops, etc.) to which a hook, loop, or other structural element may be removably attached. To further emphasize this point, FIG. 13 is a side isometric view of a selectorized lever assembly 140 mounted to a base 142 in accordance with a third exemplary embodiment; and FIG. 14 is a bottom isometric view of selectorized lever assembly 140 (base 142 is not shown). In this particular example, selectorized lever assembly 140 comprises a plurality of rigid bars links, which are rotatably joined together to form a first scissor linkage sub-assembly 144 and a second scissor linkage sub-assembly 146. As is most clearly shown in FIG. 10, the rigid bar links of lever assembly 90 are rotatably coupled by way of a plurality of pins or rungs 148, each of which extends from scissor linkage sub-assembly 144 to scissor linkage sub-assembly 146. When the exercise machine employing selectorized lever assembly 140 is assembled, an upper portion of selectorized lever assembly, such as the uppermost rung 148 (identified as rung 148(*a*) FIGS. 13 and 14) may be coupled to the exercise machine's user-manipulated element (e.g., user-manipulated element 32 shown in FIGS. 1, 3, and 4; or user-manipulated element 82 shown in FIG. 5) via a cable (e.g., cable 50 shown in FIGS. 1, 3, and 4; or cable 96 shown in FIGS. 5-7 and 9-12), belt, chain, lever, or other such linkage.

As noted above, and as shown most clearly in FIG. 13, the lower portion of selectorized lever assembly 140 is mounted to base 142. More specifically, one of the lowermost rungs 148 (identified as rung 148(*b*) in FIGS. 13 and 14) is rotatably coupled through a projection 150 extending upwardly from base 142; and the other lowermost rung 148 (identified as rung 148(*c*) in FIGS. 13 and 14) is disposed through an elongated slot 152 of a horizontal guide rail 154 provided on base 142. As selectorized lever assembly 140 extends and retracts in conjunction with the movement of a user-manipulated element (not shown), rung 148(*b*) rotates within projection 150 and rung 148(*c*) slides within horizontal guide rail 154; i.e., rung 148(*c*) moves toward projection 150 and rung 148(*b*) as lever assembly 140 extends, and rung 148(*c*) moves away from projection 150 and rung 148(*b*) as lever assembly 140 retracts. As a result of this configuration, the row of rungs 148 including rung 148(*a*) and 148(*b*) (i.e., the leftmost row of rungs 148 in FIGS. 13 and 14) travels along a substantially linear path with each rung 148 in this row traveling a different distance for a given movement of lever assembly 140. Notably, the rungs 148 disposed between rung 148(*a*) and rung 148(*b*) (identified as rungs 148(*d*) in FIGS. 13 and 14) serve as a plurality of user-selectable coupling features to which an input load (not shown) may be selectively mechanically coupled by a user utilizing a manual coupling means. For example, and as indicated in FIG. 13, a carbineer 156 coupled to a non-illustrated input load via a cable 158 (partially shown in FIG. 13) may be hooked onto a selected rung 148(*d*) by a user. After being hooked onto a selected rung 148(*d*), carbineer 156 is pulled upward and the input load coupled thereto is displaced accordingly. As each rung 148(*d*) travels a different distance per extension of lever assembly 140, the amount of displacement of the input load, and thus the resistive force opposing the movement of uppermost rung 148(*a*) and the user-manipulated element mechanically coupled thereto, is determined by the particular rung 148(*d*) onto which the user has chosen to hook carabineer 156. In this manner, selectorized lever assembly 140 permits a user to select a desired output resistance derived from the predetermined input resistance or input resistances provided by the input load.

Additional Examples of the Selectorized Lever Assembly

Figure 15:
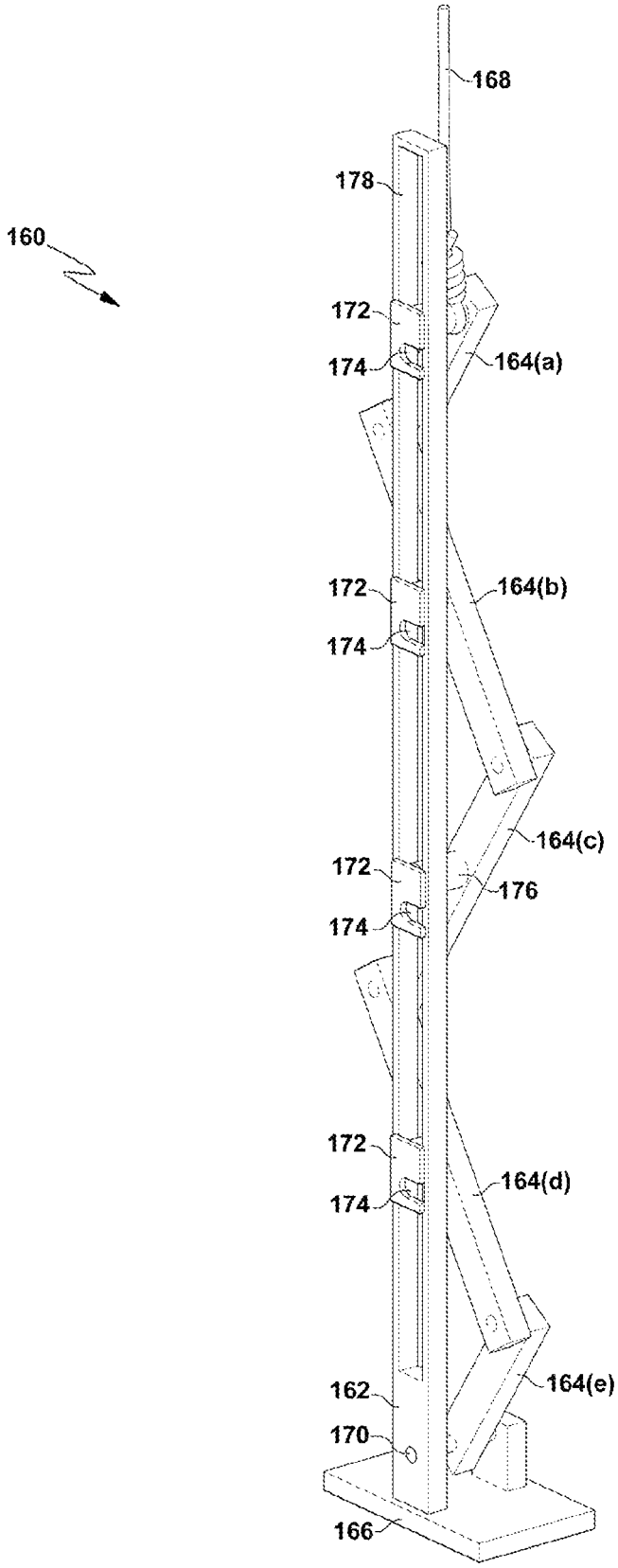
FIGS. 15, 16, and 17 are front isometric, rear isometric, and front plan views, respectively, of a simplified selectorized lever assembly including a vertical guide rail and a plurality of series-coupled levers in accordance with a further exemplary embodiment.
Figure 16:
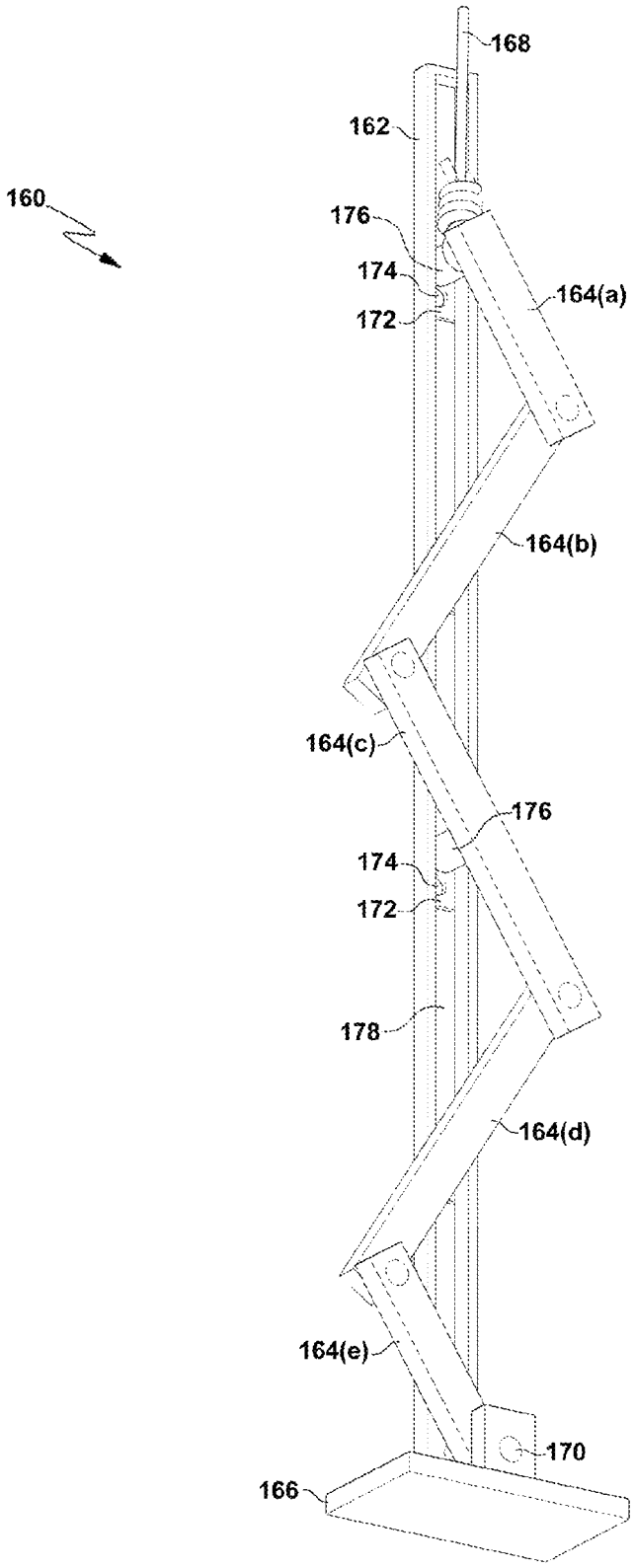

In the above-described examples, the selectorized lever assembly included a number of scissor linkages joined together in an end-to-end or linearly articulating configuration; however, this need not always be the case. In many embodiments, the selectorized lever assembly may include a single plurality of series-coupled levers. Further illustrating this point, FIGS. 15 and 16 are front and rear isometric views, respectively, of a simplified or truncated selectorized lever assembly 160 including a vertical guide rail 162 and a plurality of linearly-articulating, series-coupled levers 164. In this simplified example, series-coupled levers 164 include a total of five levers 164(*a*), 164(*b*), 164(*c*), 164(*d*), and 164(*e*), which are rotatably joined together in an end-to-end arrangement. Vertical guide rail 162 is mounted to and extends upwardly from a base 166, which may be included within the support structure of an exercise machine of the type described above. At its lower end, the plurality of series-coupled levers 164, and specifically lever 164(*e*), is rotatably mounted to vertical guide rail 162 (indicated in FIGS. 15 and 16 at 170). At its upper end, the plurality of series-coupled levers 164, and specifically lever 164(*a*), is coupled to a non-illustrated user-manipulated element via a cable 168 (partially shown in FIGS. 15 and 16).

Selectorized lever assembly 160 further includes a plurality of translating faceplates 172. A user-selectable coupling features is formed in, on, or coupled to each faceplate 172. As indicated above, the user-selectable coupling feature may assume any structural form that can be selectively coupled by a user to a non-illustrated input resistance assembly (e.g., input resistance assembly 40 shown in FIGS. 1, 3, and 4; or input resistance assembly 90, 92 shown in FIGS. 5-9, 11, and 12), such as a projection, hook, rung, ledge, shelf, slot, groove, or cutout formed in or fixedly coupled to each faceplate 172. In this particular example, the user-selectable coupling feature assumes the form of an opening or channel 174 formed in each faceplate 172 that can accommodate a conventional selector pin (e.g., selector pin 68 shown in FIGS. 1, 3, and 4 or selector pin 134 shown in FIGS. 7, 11, and 12) or other fastening member to mechanically couple the selected faceplate 172 to a component of the input resistance assembly (e.g., lever-load adapter 92 shown in FIGS. 6-8, 11, and 12).

Figure 17:
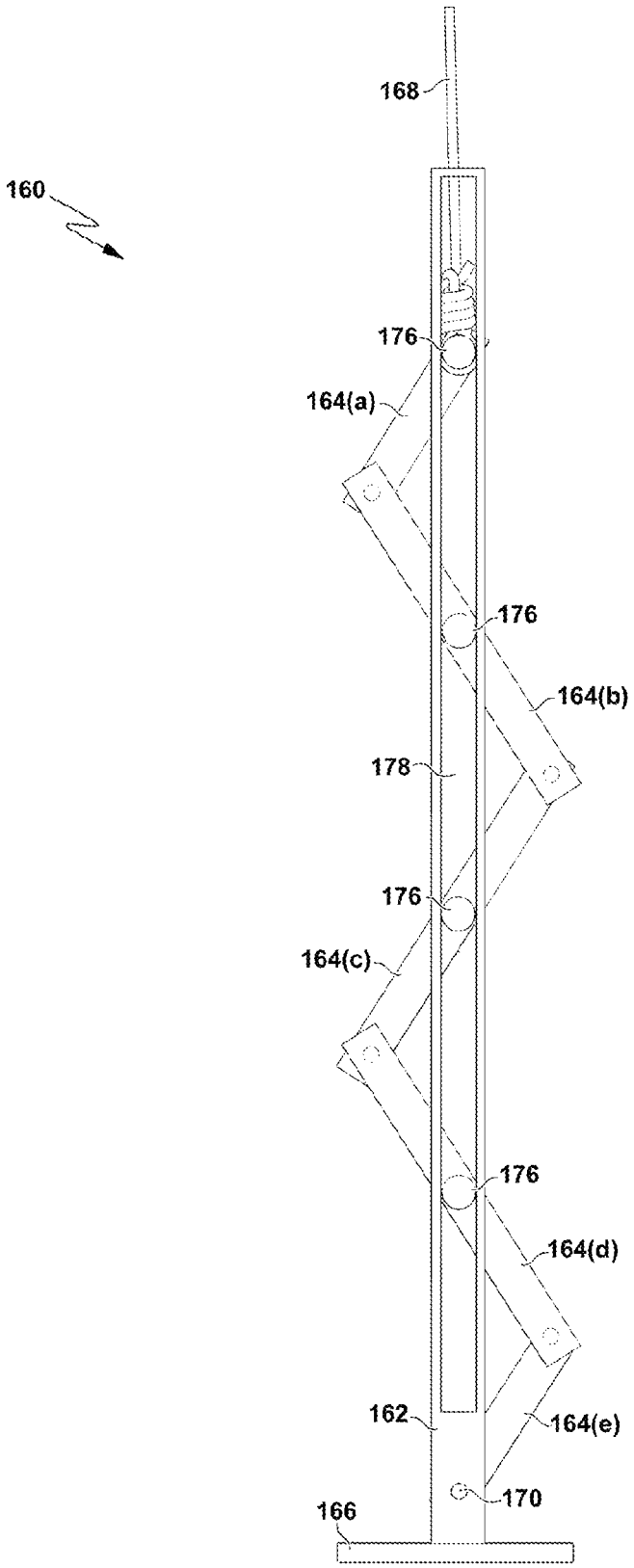

Faceplates 172 are each rotatably coupled to a different lever included within series-coupled levers 164. More specifically, each faceplate 172 is rotatably coupled to a different lever 164 via a cylindrical extension 176, which extends outwardly from series-coupled levers 164 and through a vertical slot 178 provided in vertical guide rail 162. FIG. 17 is front plan view of selectorized lever assembly 160 having faceplates 172 hidden from view to illustrate cylindrical extensions 176 in greater detail. As can be seen in FIG. 17, cylindrical extensions 176 each have an outer diameter that is slightly less than the width of slot 178 of vertical guide rail 162. Cylindrical extensions 176 are consequently prohibited from moving laterally and are generally confined to linear movement with slot 178. As a result, the central portions of series-coupled levers 164(*a*)-(*d*) are also confined to linear movement, and the movement of series-coupled levers 164 is mechanically synchronized. Stated differently, the lever assembly formed by vertical guide rail 162 and series-coupled levers 164 comprises a kinematic chain having a single degree of freedom. Thus, when a user moves the user-manipulated element (not shown) coupled to series-coupled levers 164, cable 168 pulls lever 164(*a*) upward and levers 164 collectively extend such that faceplates 172, and therefore the user-selectable channels 174, each move a different vertical distance. By selecting which user-selectable coupling feature is mechanically coupled to the non-illustrated input resistance assembly, a user may derive a desired output resistance from the input resistance or input resistances supplied by the input resistance assembly. Faceplates 172 engage vertical guide rail 162 to prevent the rotation along with series-coupled levers 164 during extension and retraction of selectorized lever assembly 160.

While translating faceplates 172 are disposed adjacent series-coupled levers 164 in the above-described example, faceplates 172 can be located remote from series-coupled lever 164 in alternative embodiments. For example, in an alternative embodiment, faceplates 172 can be disposed between a first plurality of series-coupled levers and a second plurality of series-coupled levers, which are laterally spaced apart. In this case, faceplates 172 may be mechanically connected to the first plurality of series-coupled levers and to the second plurality of series-coupled levers via a plurality of horizontal beams or other elongated structures.

CONCLUSION

In view of the above, it should be appreciated that there has been provided multiple exemplary embodiments of a user-adjustable resistance mechanism suitable for employment within an exercise machine that enables a user to select amongst a plurality of output resistances derived from a single input resistance (or range of input resistances) utilizing, for example, an intuitive selection interface similar to that employed by traditional stacked weight exercise machines. The user-adjustable resistance mechanism may be combined with other resistance mechanisms or sources of resistance in further embodiments. For example, the user-adjustable resistance mechanism can be mechanically coupled in series with a traditional weight stack. In this particular case, it may be desirable for the user-adjustable resistance to employ an input load, such as one or more springs or elastic bands, that provides a low initial resistive force that increases steadily (e.g., in a generally linear manner) with increasing deformation. In this manner, a user can utilize the user-adjustable resistance mechanism to select the rate at which the cumulative resistive force opposing movement of the user manipulated increases during the concentric phase of an exercise set independently of the particular output resistance provided by the weight stack.

Various embodiments of a user-adjustable resistance mechanism have been provided for use in conjunction with an exercise apparatus including a user-manipulated element and a support structure. In one exemplary embodiment, the user-adjustable resistance mechanism includes an input resistance assembly and a selectorized lever assembly. The selectorized lever assembly, in turn, includes a first portion mounted to the support structure, a second portion mechanically coupled to the user-manipulated element and moving in conjunction therewith such that the selectorized lever assembly extends as the user-manipulated element is moved by a user, and a plurality of user-selectable coupling features between the first portion and the second portion of the selectorized lever assembly. Each coupling feature in the plurality of user-selectable coupling features: (i) travels a different distance as the selectorized lever assembly extends, and (ii) is configured to be selectively mechanically coupled to the input resistance assembly by a user to determine the magnitude of the resistance opposing extension of the selectorized lever assembly and, therefore, opposing movement of the user-manipulated element.

Embodiments of the user-adjustable resistance mechanism set-forth above can also be conveniently described utilizing means-plus-function terminology. For example, the foregoing has provided a user-adjustable resistance mechanism for use in conjunction with an exercise apparatus including a user-manipulated element and a support structure. In one embodiment user-adjustable resistance mechanism includes a first plurality of levers rotatably coupled in series between the user-manipulated element and the support structure, resistive means for providing a predetermined input resistance, and coupling means for selectively coupling the resistive means to the first plurality of levers at any one of a plurality of locations to determine the cumulative load arm length of the first plurality of levers and the output resistance opposing movement of the user-manipulated element.

Certain embodiments of the user-adjustable resistance mechanism set-forth above may also be described as including one or more guide member in addition to a plurality of series-coupled levers. In each of the above-described exemplary embodiments, the guide member comprises one or more structural elements that restrict the movement of a point on each of the series-coupled levers to a predetermined motion path. In so doing, the guide member mechanically synchronizes the movement of the series-coupled levers; i.e., forces the levers to move in substantial unison. The guide member may include one or more structural elements and, in certain cases, may itself comprise a plurality of series-coupled levers. For example, in the exemplary case of exercise apparatus 30 shown in FIGS. 1-4, series-coupled levers 56 may be considered the guide member for series coupled levers 58 or, conversely, series-coupled levers 58 may be considered the guide member for series-coupled levers 56; in either case, the combination of levers 56 and levers 58, joined together to form a linearly-articulating series of scissor linkages, ensures that appreciable movement of any given lever will result in movement of the other levers along the predetermined motion path. Alternatively, the guide member may comprise one or more slider joints or slots for guiding the movement of the series-coupled levers. An example of such a guide member including such a slider joint or slot is vertical guide rail 162 described above in conjunction with FIGS. 15-17.

While described above in the context of various exemplary exercise machines, embodiments of user-adjustable resistance mechanism may be utilized in any context (e.g., as a counter-balance system) wherein it is desired to provide a relatively simple user interface, such as a pin insertion interface, that enables a user to select amongst a plurality of output resistances derived from one or more predetermined input resistances. While multiple exemplary embodiments have been presented in the foregoing Detailed Description, it should be appreciated that a vast number of variations exist. It should also be appreciated that the exemplary embodiments are only examples, and are not intended to limit the scope, applicability, or configuration of the invention in any way. Rather, the foregoing Detailed Description will provide those skilled in the art with a convenient road map for implementing a desired embodiment of the invention. It being understood that various changes may be made in the function and arrangement of elements described in an exemplary embodiment without departing from the scope of the invention as set-forth in the appended Claims.

What is claimed is:

1. An exercise apparatus, comprising:

a support structure;

a user-manipulated element movably coupled to the support structure and configured to be moved by a user during the performance of an exercise in opposition to an output resistance; and a user-adjustable resistance mechanism, comprising:

a lever assembly comprising a first plurality of levers rotatably coupled in series between the user-manipulated element and the support structure; and an input resistance assembly configured to be selectively coupled by a user to the lever assembly at any one of a plurality of locations to determine the cumulative load arm length of the first plurality of levers and the output resistance opposing movement of the user-manipulated element.

2. An exercise apparatus according to claim 1 wherein movement of the first plurality of levers is mechanically synchronized.

3. An exercise apparatus according to claim 1 wherein the input resistance assembly comprises:

an input load; and a lever-load adapter coupled to the input load and configured to be selectively coupled by a user to the lever assembly at any one of the plurality of locations.

4. An exercise apparatus according to claim 3 wherein the exercise apparatus is configured to be utilized in conjunction with a selector pin, and wherein the user-adjustable resistance mechanism further comprises a pin insertion interface formed, at least in part, by the lever assembly and the lever-load adapter, the pin insertion interface enabling a user to select which of the plurality of locations is mechanically coupled to the lever-load adapter via insertion of the selector pin.

5. An exercise apparatus according to claim 4 wherein the lever assembly includes a plurality of apertures through which the selector pin can be inserted to mechanically couple the lever-load adapter to the first plurality of levers.

6. An exercise apparatus according to claim 1 wherein the lever assembly further comprises a second plurality of levers coupled: (i) in series between the user-manipulated element and the support structure, and (ii) in parallel with the first plurality of levers.

7. An exercise apparatus according to claim 6 wherein the lever assembly comprises a plurality of scissor linkages formed, at least in part, by the first plurality of levers and the second plurality of levers.

8. An exercise apparatus according to claim 1 wherein the first plurality of levers is configured to extend along an extension/retraction axis as the user-manipulated element is moved by a user.

9. An exercise apparatus according to claim 8 wherein each of the plurality of locations travels along a substantially linear path as the first plurality of levers extends along the extension/retraction axis.

10. An exercise apparatus according to claim 9 wherein the paths traveled by the plurality of locations are each substantially parallel with the extension/retraction axis.

11. An exercise apparatus according to claim 8 wherein the plurality of locations disperses along the extension/retraction axis as the first plurality of levers extends along the extension/retraction axis.

12. An exercise apparatus according to claim 8 wherein the support structure comprises a base, and wherein the lever assembly comprises:

an anchored end portion rotatably mounted to the base; and a fully articulating end portion coupled to the user-manipulated element and configured to move away from the base as the first plurality of levers extends along the extension/retraction axis.

13. An exercise apparatus according to claim 12 wherein each of the plurality of locations travels a different distance away from the base as the lever assembly extends along the extension/retraction axis.

14. An exercise apparatus according to claim 1 wherein the lever assembly comprises a plurality of user-selectable coupling features each configured to be selectively mechanically coupled to the input resistance assembly by a user.

15. An exercise apparatus according to claim 14 wherein the plurality of user-selectable coupling features comprises a plurality of channels formed through the lever assembly.

16. An exercise apparatus, comprising:

a user-manipulated element configured to be moved by a user during the performance of an exercise; and a user-adjustable resistance mechanism, comprising:

a linearly-articulating lever assembly coupled to the user-manipulated element and configured to extend along an extension/retraction axis as the user-manipulated element is moved by the user during the performance of an exercise;

an input load; and a lever-load adapter mechanically coupled to the input load and configured to be selectively mechanically coupled by the user to the linearly-articulating lever assembly at any one of a plurality of locations, each location in the plurality of locations traveling a different distance as the first plurality of linearly-articulating lever assembly extends along the extension/retraction axis such that the displacement of the input load is dependent upon the location at which the user has coupled the lever-load adapter to the linearly-articulating lever assembly.

17. An exercise apparatus according to claim 16 wherein the lever-load adapter resides adjacent the linearly-articulating lever assembly and is configured to move in conjunction with the linearly-articulating lever assembly, when coupled thereto, along an axis substantially parallel to the extension/retraction axis.

18. An exercise apparatus, comprising:

a user-manipulated element configured to be moved by a user during the performance of an exercise in opposition to an output resistance; and a user-adjustable resistance mechanism, comprising:

an input resistance assembly configured to provide at least one predetermined resistance; and a lever assembly including a first plurality of series-coupled levers coupled to the user-manipulated element, the lever assembly cooperating with the input resistance assembly to enable the user to manually select which lever in the first plurality of series-coupled levers is coupled most directly to the input resistance assembly to determine the cumulative load arm of the first plurality of series-coupled levers and the magnitude of the output resistance derived from the at least one predetermined input resistance.

19. An exercise apparatus, comprising:

a support structure;

a user-manipulated element coupled to the support structure and configured to be moved by a user during the performance of an exercise in opposition to an output resistance; and a user-adjustable resistance mechanism, comprising:

an input resistance assembly; and a selectorized lever assembly, comprising:

a first portion mounted to the support structure;

a second portion mechanically coupled to the user-manipulated element and moving in conjunction therewith such that the selectorized lever assembly extends as the user-manipulated element is moved by a user; and a plurality of user-selectable coupling features between the first portion and the second portion of the selectorized lever assembly, each coupling feature in the plurality of user-selectable coupling features: (i) traveling a different distance as the selectorized lever assembly extends, and (ii) configured to be selectively mechanically coupled to the input resistance assembly by a user to determine the magnitude of the output resistance opposing extension of the selectorized lever assembly and, therefore, the magnitude of the output resistance opposing movement of the user-manipulated element.

20. An exercise apparatus, comprising:

a support structure;

a user-manipulated element coupled to the support structure and configured to be moved by a user during the performance of an exercise in opposition to an output resistance; and a user-adjustable resistance mechanism, comprising:

a lever assembly comprising a first plurality of levers rotatably coupled in series between the user-manipulated element and the support structure;

resistive means for providing at least one predetermined input resistance; and coupling means for selectively coupling the resistive means to the lever assembly at any one of a plurality of locations to determine the cumulative load arm of the first plurality of levers and the magnitude of the output resistance derived from the at least one predetermined input resistance.

21. A user-adjustable resistance mechanism, comprising:

a lever assembly comprising a first plurality of levers rotatably coupled in series; and an input resistance assembly configured to be selectively coupled by a user to the lever assembly at any one of a plurality of locations to determine the cumulative load arm length of the first plurality of levers and the output resistance of the user-adjustable resistance mechanism.

* * * * *